US005711157A

United States Patent [19]

Ohtani et al.

[11] Patent Number: 5,711,157

[45] Date of Patent: Jan. 27, 1998

[54] COOLING SYSTEM HAVING A PLURALITY OF COOLING STAGES IN WHICH REFRIGERANT-FILLED CHAMBER TYPE REFRIGERATORS ARE USED

[75] Inventors: Yasumi Ohtani; Masahiko Takahashi; Hideo Hatakeyama; Rohana Chandratilleke, all of Yokohama, Japan; Toru Kuriyama, Boulder, Colo.; Hideki Nakagome, Tokyo, Japan; Takayuki Kobayashi; Tomomi Hattori, both of Yokohama, Japan; Tatsuya Yoshino, Tokyo, Japan

[73] Assignee: Kabushiki Kaisha Toshiba, Kawasaki, Japan

[21] Appl. No.: 647,741

[22] Filed: May 15, 1996

[30] Foreign Application Priority Data

| | | | |
|---|---|---|---|
| May 16, 1995 | [JP] | Japan | 7-117497 |
| May 16, 1995 | [JP] | Japan | 7-117500 |
| May 16, 1995 | [JP] | Japan | 7-117540 |
| Mar. 15, 1996 | [JP] | Japan | 8-059193 |

[51] Int. Cl.[6] ..... F25B 9/00

[52] U.S. Cl. ..... 62/6; 62/467

[58] Field of Search ..... 62/6, 467

[56] References Cited

U.S. PATENT DOCUMENTS

| | | | |
|---|---|---|---|
| 3,902,328 | 9/1975 | Claudet | 62/6 |
| 5,181,383 | 1/1993 | Goto et al. | 62/6 |
| 5,295,355 | 3/1994 | Zhou et al. | 62/6 |
| 5,335,505 | 8/1994 | Ohtani et al. | 62/6 |
| 5,387,252 | 2/1995 | Nagao | 62/6 |
| 5,412,952 | 5/1995 | Ohtani et al. | 62/6 |
| 5,440,883 | 8/1995 | Harada | 62/6 |

OTHER PUBLICATIONS

J. L. Gao, et al., "A Hybrid Two–Stage Refrigerator Operated at Temperatures Below 4 K", Cryogenic Engineering Conference (Columbus, Ohio USA), Jul. 17–21, 1995.

*Primary Examiner*—Christopher Kilner

*Attorney, Agent, or Firm*—Oblon, Spivak, McClelland, Maier & Neustadt, P.C.

[57] ABSTRACT

A superconducting magnet apparatus comprises a superconducting coil unit, and a refrigerant-filled chamber type refrigerator having a plurality of cooling stages. At least a final cooling stage of the cooling stages includes a static-type refrigerant-filled chamber and is associated with the superconducting coil unit, and at least a first cooling stage of the cooling stages includes a movable-type refrigerant-filled chamber.

26 Claims, 19 Drawing Sheets

COOLING SYSTEM HAVING A PLURALITY OF COOLING STAGES IN WHICH REFRIGERANT-FILLED CHAMBER TYPE REFRIGERATORS ARE USED

BACKGROUND OF THE INVENTION

1. Field of the Invention

The present invention relates to a cooling system, such as a refrigerant-filled chamber type refrigerator or a superconducting magnet device, for cryogenically cooling an object.

2. Description of the Related Art

As is well known, most of currently available superconducting magnet apparatus adopt an immersion cooling system and a cryogenic cooling system. In the immersion cooling system, a superconducting coil and a cryogenic refrigerant, represented by liquid helium, are contained together in a heat-insulating container. In the cryogenic cooling system, a thermal shield provided in a heat-insulating layer in a heat-insulating container is cooled by a cryogenic refrigerator. In recent years, superconducting magnet apparatus of a refrigerator direct-cooling system, wherein a superconducting coil contained in a heat-insulating container is directly cooled by a cryogenic refrigerator, have been developed. In these superconducting magnet apparatus, in order to obtain a sufficiently low target temperature with a simple structure, a multiple-stages of refrigerant-filled chamber type refrigerators are used as cryogenic refrigerators.

FIG. 1 shows an example of a conventional superconducting magnet apparatus adopting the immersion cooling system. In general, as is shown in FIG. 1, a heat-insulating container 1 comprises an inner bath 2, an outer bath 3, a vacuum heat-insulating layer 4 defined between the inner bath 2 and outer bath 3, and, e.g. double-structured thermal shields 5 and 6 surrounding the inner bath 2 within the vacuum heat-insulating layer 4.

Liquid helium 7 or a cryogenic refrigerant is contained within the inner bath 7. A superconducting coil 8 is situated such that it is immersed in the liquid helium 7. For the purpose of simplicity, FIG. 1 does not show a current lead for supplying from the outside a current to the superconducting coil 8, a liquid injection pipe for injecting the liquid helium 7 into the inner bath 2, or an exhaust pipe for recovering the helium gas generated within the inner bath 2.

A refrigerant-filled chamber type refrigerator 9 is provided so as to extend inside and outside the heat-insulating container 1. The refrigerator 9 absorbs heat which may enter the inner bath 2 by radiation, etc., thereby to maintain the temperature environment. An example of the refrigerator 9 is a refrigerator having a Gifford-McMahon refrigeration cycle ("GM refrigerator").

The GM refrigerator 9 comprises, for example, a first cooling stage 27 and a second cooling stage (a final cooling stage in this case) having a target temperature lower than the first cooling stage 27. The outer thermal shield 6 is cooled to, e.g. about 50 K by the first cooling stage 27. The inner thermal shield 6 is cooled to, e.g. about 10 K by the second cooling stage 28.

FIG. 2 schematically shows the structure of the GM refrigerator 9 of two-stage expansion type. The GM refrigerator 9 comprises a cold head 21 for cooling, e.g. helium gas and a compressor 22.

In the cold head 21, a displacer 24 formed of a heat-insulating material is reciprocally movably housed within a closed cylinder 23. The cylinder 23 comprises a large-diameter first cylinder 25 and a small-diameter second cylinder 26 coaxially connected to the first cylinder 25. In general, the first cylinder 25 and second cylinder 26 are formed of thin stainless steel plates.

The aforementioned first and second cooling stages 27 and 28 are provided within the first and second cylinders 25 and 26, respectively. Specifically, the first cooling stage 27 generates coldness by expanding a compressed refrigerant gas at a head wall portion of the first cylinder 25. The second cooling stage 28 generates coldness at a temperature lower than the temperature of the coldness generated by the first cooling stage 27, by expanding a compressed refrigerant gas at a head wall portion of the second cylinder 26.

The displacer 24 comprises a first displacer 29 reciprocally movable in the first cylinder 25, and a second displacer 30 reciprocally movable in the second cylinder 26. The first displacer 29 and second displacer 30 are axially coupled by a coupling mechanism 31.

An axially extending fluid passage 32 for constituting a first-stage refrigerant-filled chamber is formed within the first displacer 29. The fluid passage 32 contains mesh-like coldness-accumulating material 33 formed of, e.g. copper. Similarly, a fluid passage 34 for constituting a second-stage (final-stage) refrigerant-filled chamber is formed within the second displacer 30. Coldness-accumulating material 35 formed of, e.g. lead grains are contained in the fluid passage 34.

A seal member 36 is provided between an upper portion of the outer peripheral surface of the first displacer 29 and the inner peripheral surface of the first cylinder 25, and a seal member 37 is provided between the outer peripheral surface of the second displacer 30 and the inner peripheral surface of the second cylinder 26.

An upper end portion of the first displacer 29 is coupled to a rotary shaft of a motor 39 via a coupling rod, a scotch yoke or a crank shaft 38. If the motor 38 is rotated, the displacer 24 is reciprocally moved in synchronism with the rotation of the motor 39, as indicated by a solid-line double-headed arrow in FIG. 2.

An inlet 40 for introducing helium gas into the first displacer 29 and an outlet 41 for exhausting the helium gas are provided in the upper space of the first cylinder 25. The inlet 40 and outlet 41 are connected to a compressor 22 via a high-pressure valve 42 and a low-pressure valve 43 which are opened/closed in synchronism with the rotation of the motor 39. The compressor 22, high-pressure valve 42 and low-pressure valve 43 constitute a helium gas circulating system passing through the cylinder 23. Specifically, two operations are alternately performed: one operation being such that low-pressure (about 8 atm) helium gas is compressed by the compressor 22 and the pressurized helium gas (about 20 atm) is fed into the cylinder 23, the other being such that the helium gas is exhausted from the inside of the cylinder 23.

The refrigerating operation of the GM refrigerator 9 having the above structure will now be described in brief. Specifically, coldness is generated by the first cooling stage 27 and second cooling stage 28. The first cooling stage 27 is cooled down to about 30 K in an ideal condition with no thermal load. The second cooling stage 28 is cooled down to about 8 K when lead is used as coldness-accumulating material 35. Accordingly, a temperature gradient between normal temperature (300 K) and 30 K is provided between the upper and lower ends of the first displacer 29, and a temperature gradient between 30 K and 8 K is provided between the upper and lower ends of the second displacer 30. The temperatures of the first and second cooling stages 27 and 28 vary, depending on thermal load. Normally, the temperature of the first cooling stage 27 is 30 K to 80 K and that of the second cooling stage 28 is 8 K to 20 K.

When the motor 39 starts to rotate, the displacer 24 reciprocally moves between the bottom dead point (the highest point in FIG. 2) and the top dead point (the lowest point in FIG. 2). When the displacer 24 has reached the top dead point, the high-pressure valve 42 opens and the high-pressure helium gas enters the cylinder 23. Then, the displacer 24 moves towards the bottom dead point.

As has been described above, the seal member 36 is provided between the outer peripheral surface of the first displacer 29 and the inner peripheral surface of the first cylinder 25, and a seal member 37 is provided between the outer peripheral surface of the second displacer 30 and the inner peripheral surface of the second cylinder 26. Accordingly, if the displacer 24 moves towards the bottom dead point, the high-pressure helium gas flows to a first expansion chamber 44 and a second expansion chamber 45 through the fluid passages 32 and 34. As the high-pressure helium gas flows, it is cooled by the coldness-accumulating materials 33 and 35. The high-pressure helium gas which has entered the first expansion chamber 44 is cooled to about 30 K, and the high-pressure helium gas which has entered the second expansion chamber 45 is cooled to about 8 K.

When the displacer 24 has reached the bottom dead point, the high-pressure valve 42 is closed and the low-pressure valve 43 is opened. If the low-pressure valve 43 is opened, the high-pressure helium gas in the first and second expansion chambers 44 and 45 adiabatically expands and generates coldness. By the generated coldness, the first cooling stage 27 absorbs external heat and the second cooling stage 28, too, absorbs external heat. When the displacer 24 moves towards the top dead point once again, the low-temperature helium gas in the first and second expansion chambers 44 and 45 passes through the fluid passages 34 and 32 and cools the coldness-accumulating materials 35 and 33. The heated helium gas is exhausted via the low-pressure valve 43 from the upper part of the cylinder 23 to the compressor 22.

The above-described cycle is repeated to carry out the refrigerating operation. Thus, the thermal shield 6 shown in FIG. 1 is cooled to, e.g. about 50 K, and the thermal shield 5 is cooled to, e.g. about 10 K. Thereby, heat is prevented from entering the inner bath 2.

In the superconducting magnet apparatus adopting the immersion cooling system, the amount of evaporation of liquid helium 7 contained in the inner bath 2 is proportional to the amount of heat entering the inner bath 2. About 1.4 l of liquid helium evaporates per hour with respect to the amount of entering heat of 1 W. The amount of heat entering the inner bath 2 decreases as the temperature of, in particular, the thermal shield 5, which is situated closest to the inner bath 2, is lower. Since the thermal shield 5 is cooled by the final cooling stage, i.e. the second cooling stage 28 of the GM refrigerator 9, the second cooling stage 28 needs to be kept at low temperature in order to maintain the amount of evaporation of liquid helium 7 at a low level.

In order to meet this requirement, the refrigeration power of each cooling stage needs to be enhanced. In order to enhance the refrigeration power, it is important to sufficiently reduce the amount of leak at the sealing devices 36 and 37, and to prevent an increase in leak with the passing of time. In particular, since the temperature of the second cooling stage 28 is low, the refrigeration power of the second cooling stage 28 depends greatly on the amount of leak at the sealing device 37.

A lubricating oil, however, cannot be used in the sealing device 37 which is located in the cryogenic region of 30 K to 50 K. In addition, if the sealing device is cooled to these temperatures, a large difference occurs in thermal contraction amount among a sealing member assembled in the sealing device 37, the constituent material of the second displacer 30 and the constituent material of the second cylinder 26. Consequently, the amount of leak becomes greater than at normal temperature. Furthermore, since the sealing member slides, the amount of leak gradually increases due to abrasion with the passing of time.

For these reasons, it is difficult to maintain the temperature of the second cooling stage 28 at a sufficiently low level for a long time period. Consequently, the temperature of the thermal shield 5 increases and the amount of evaporation of liquid helium 7 increases.

On the other hand, a coldness-accumulating material having a relatively great specific heat at very low temperatures has recently been developed. An example of such material is $Er_3Ni$. FIG. 3 shows specific heats of $Er_3Ni$ and lead. As shown in FIG. 3, $Er_3Ni$ is a magnetic material having abnormal magnetic specific heat at low temperatures due to a magnetic phase transition. As is understood from FIG. 3, $Er_3Ni$ has a much greater specific heat than lead at temperatures of 15 K or below. Thus, if $Er_3Ni$ is used as coldness-accumulating material 35 of the final-stage refrigerant-filled chamber of the GM refrigerator 9 shown in FIG. 1, the second cooling stage 28 can be cooled to about 4 K, i.e. the temperature of liquid helium.

Recently, a superconducting magnet adopting a refrigerator direct cooling system, as shown in FIG. 4, has been proposed. In this apparatus, a superconducting coil 8 is directly cooled by a GM refrigerator 9*a* using, as coldness-accumulating material 35 of the final-stage refrigerant-filled chamber, a magnetic coldness-accumulating material such as $Er_3Ni$ having abnormal magnetic specific heat at low temperatures due to a magnetic phase transition.

In this superconducting magnet apparatus, a vacuum container 51 is used as heat-insulating container. The superconducting coil 8 is disposed within the vacuum container 51. A thermal shield 52 is provided so as to surround the superconducting coil 8. The thermal shield 52 is directly cooled by the first cooling stage 27 of the GM refrigerator 9*a*. The superconducting coil 8 is directly cooled by the second cooling stage 28 of the GM refrigerator 9*a* via heat conductive members 53, 54 and 55. FIG. 4 does not show a current lead for supplying current to the superconducting coil 8 from the outside, or position holding means for the superconducting coil and thermal shield.

In this superconducting magnet apparatus, too, the GM refrigerator 9*a* having sliding seal elements in a cryogenic region is used similarly. It is difficult, therefore, to enhance the refrigeration power of the final cooling stage, like the apparatus shown in FIG. 1. In addition, since the coldness-accumulating material held in the final-stage displacer is a magnetic coldness-accumulating material, the magnetic coldness-accumulating material is influenced by a magnetic field generated by the superconducting coil 8 and excessive force is applied to the reciprocally moving final-stage displacer. Although the excessive force depend on the magnetic field and the gradient of magnetic field, if the force acts on the final-stage displacer, the displacer is inclined. As a result, the amount of leak of the dealing device increases, frictional heat occurs due to pressure contact between the displacer and the inner wall of the cylinder, and reciprocal movement frequency varies due to an increase in driving force of the displacer. Consequently, the refrigeration power of the final cooling stage deteriorates and the superconducting coil 8 may be quenched.

As has been described above, the superconducting magnet apparatus, wherein the environment of temperature of the superconducting coil is maintained by using the refrigerant-filled chamber type refrigerator in which the refrigerant-filled chamber is held within the displacer and the refrigerating operation is performed while the refrigerant-filled chamber is moving, has the following problems. That is, the refrigerator is adversely affected by the aforementioned inherent factor of the superconducting coil and it is difficult to enhance the performance of the refrigerator. Consequently, the amount of evaporation of cryogenic refrigerant may increase and the superconducting coil may be quenched.

An object of the present invention is to provide a superconducting magnet apparatus, wherein the temperature environment of a superconducting coil can be stably maintained for a long time, and to provide a refrigerant-filled chamber type refrigerator used in the superconducting magnet apparatus.

Another object of the invention is to provide a refrigerant-filled chamber type refrigerator, wherein the applicability to an object to be cooled is enhanced and the cooling performance of a final-stage cooling section is increased, and to provide a superconducting magnet apparatus using the refrigerant-filled chamber type refrigerator.

SUMMARY OF THE INVENTION

A superconducting magnet apparatus of the present invention includes a plurality of cooling stages. At least a final cooling stage of the cooling stages is a refrigerant-filled chamber type refrigerator having a static-type refrigerant-filled chamber. The temperature environment of a superconducting coil is maintained by the refrigerant-filled chamber type refrigerator having the static-type refrigerant-filled chamber. The final cooling stage, the cooling stage other than the final cooling stage and the superconducting coil are situated in a specific positional relationship. The positional relationship is determined on the basis of characteristics (shape, strength, use, etc.) of the superconducting coil and characteristics (shape, capacity, use, etc.) of each cooling stage.

In the refrigerant-filled chamber type refrigerator mounted in the superconducting magnet apparatus, the part that must have the highest refrigeration power is a final cooling stage. In the present invention, the final cooling stage is of the static type, and it has no movable element. Thus, there is no need to provide a sliding seal element. Therefore, the refrigeration power is prevented from deteriorating due to the presence of the sliding seal element.

The refrigerant-filled chamber of the final stage is of the static type. Thus, when a magnetic coldness-accumulating material which makes use of, e.g. abnormal magnetic specific heat due to a magnetic phase transition is used as coldness-accumulating material of the refrigerant-filled chamber of the final stage, even if the force of a magnetic field generated by the superconducting coil acts on the magnetic coldness-accumulating material, this force does not influence the mechanical movement of the refrigerant-filled chamber type refrigerator. Thus, the refrigeration power is prevented from deteriorating due to the force of magnetic field generated by the superconducting coil. In addition, since the refrigerant-filled chamber of the final stage is of the static type, the magnetic coldness-accumulating material used as coldness-accumulating material causes no magnetic noise in the magnetic field generated by the superconducting coil.

The static-type structural part of the refrigerant-filled chamber type refrigerator is branched and the branched systems are arranged equidistantly around the axis of the superconducting coil. In addition, The final cooling stage of each of the branched systems is thermally connected to the superconducting coil. Thus, the superconducting coil can be uniformly cooled so that no temperature difference occurs in the superconducting coil. In this case, even if the magnetic coldness-accumulating material is used in the refrigerant-filled chamber of each branched system, it does not disturb the symmetry of magnetic field generated by the superconducting coil. Therefore, a correcting operation for enhancing symmetry of central magnetic field in the coil can be easily performed.

At least the final-stage portion of the static-type structural part of the refrigerant-filled chamber type refrigerator is located within a vacuum container containing the superconducting coil, and the other portion thereof is located outside the vacuum container. Thereby, vibration of the movable refrigerant-filled chamber is prevented from being directly transmitted to the superconducting coil, and it is possible to avoid a problem which may be caused by mechanical vibration transmitted to the superconducting coil.

A vibration transmission preventing unit is provided to prevent vibration from being transmitted from the first-stage movable-type refrigerant-filled chamber to the final-stage refrigerant-filled chamber, or at least a part of a pipe coupling the first- to final-stage refrigerant-filled chambers is formed of a flexible pipe portion. Thereby, vibration of the refrigerant-filled chamber is prevented from being directly transmitted to the superconducting coil.

In the present invention, the final-stage cooling unit of each cooling system is constituted by the pulse tube refrigerator. Since the pulse tube refrigerator has no movable element, there is no need to provide a sliding seal element. Therefore, the refrigeration power is prevented from deteriorating due to the presence of the sliding seal element.

Since the high-temperature end portion of the pulse tube of the pulse tube refrigerator is substantially located in a normal-temperature region, it is easy to provide a mechanism for performing a phase control necessary for the pulse tube refrigerator, i.e. a mechanism for providing a predetermined phase difference between the phase of pressure variation and the phase of displacement of gas. In other words, since the phase control mechanism of the pulse tube refrigerator is situated in the normal-temperature region, the operability, the easiness of maintenance of valves, the reliability, etc. can remarkably be enhanced.

In the present invention, the final-stage cooling unit constitutes the pulse tube refrigerator, the axis of the pulse tube of the pulse tube refrigerator is substantially parallel to the axis of the refrigerant-filled chamber, and the intersection angle between the axis of the final-stage cooling unit and the axis of the cooling unit other than the final-stage one is set at, e.g. 90° or 180°. Thus, the total length of the refrigerator can be greatly reduced, as compared with the conventional one, and the applicability to various objects to be cooled is enhanced.

In the case of the pulse tube refrigerator, if the low-temperature portion of the pulse tube is located upward in the direction of gravity and the high-temperature portion of the pulse tube is located downward in the direction of gravity, a low-temperature gas with high density is located upward. As a result, convection occurs in the pulse tube and the refrigeration power is deteriorated. Thus, in order to enhance the refrigeration power of the pulse tube refrigerator, it is necessary to situate the low-temperature portion of the pulse tube downward in the direction of gravity and the high-temperature portion of the pulse tube upward in the direction of gravity. On the other hand, convection tends to occur less easily in the cooling unit having the GM refrigerating cycle, Stirling refrigerating cycle or improved Solvay refrigerating cycle, than in the pulse tube refrigerator unit. Therefore, it is less possible that the refrigeration power of the former unit varies due to the condition for arrangement. Accordingly, if the condition for arrangement of the pulse tube refrigerator is satisfied, the advantage obtained with the feature that the total length of the refrigerator is short can be fully exhibited.

Since the pulse tube refrigerator includes no movable part, there is no need to provide a sliding seal element. Therefore, the final-stage cooling unit can exhibit high refrigeration powder.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 5:
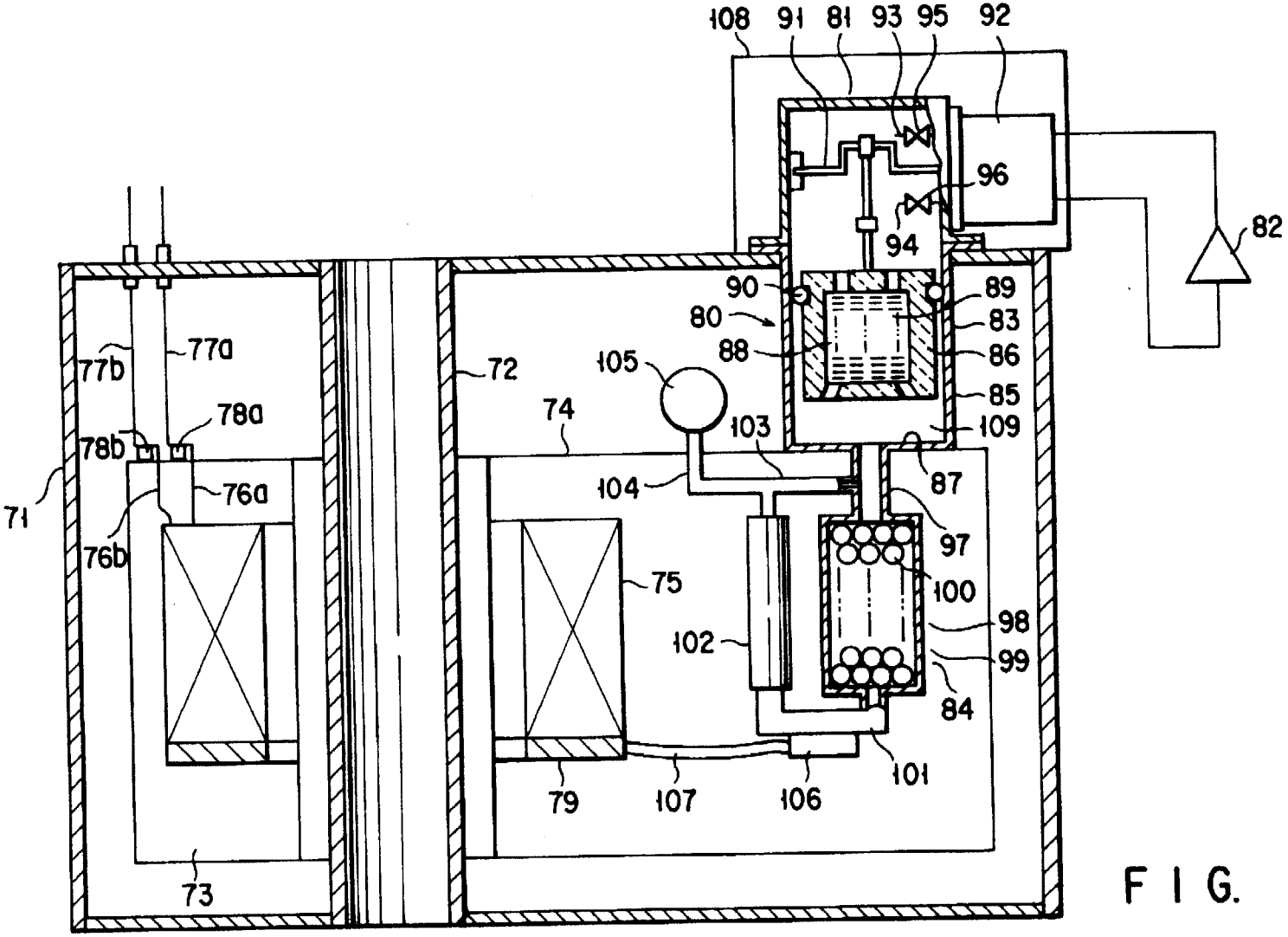
FIG. 5 schematically shows the structure of a superconducting magnet apparatus according to an embodiment of the present invention.

FIG. 5 shows a superconducting magnet apparatus of a refrigerator direct cooling system according to an embodiment of the present invention.

The main components of the superconducting magnet apparatus of this embodiment are a superconducting coil and a refrigerator. The refrigerator comprises a plurality of cooling stages, and a valve mechanism for supplying a refrigerant to each cooling stage. The final cooling stage, the other cooling stage and the superconducting coil are situated in a specific positional relationship. The positional relationship is determined on the basis of characteristics (shape, strength, use, etc.) of the superconducting coil and characteristics (shape, capacity, use, etc.) of each cooling stage.

As is shown in FIG. 5, a vacuum container 71 is integrally provided with a cylindrical wall 72 which hermetically penetrates upper and lower walls of the container 71. A thermal shield 74 formed of a non-magnetic metallic material is disposed within the vacuum container 71 so as to define an annular space 73 surrounding the cylindrical 72. A superconducting coil 75 is disposed within the annular space 73 defined by the thermal shield 74 so as to be coaxial with the cylindrical wall 72. The superconducting coil 75 is formed of a superconducting wire having a critical temperature of, e.g. about 15 K. Both end portions of the superconducting wire are connected to first end portions of current leads 76*a* and 76*b* formed of, e.g. an oxide superconducting material having a critical temperature of 50 K or above. Second end portions of the current leads 76*a* and 76*b* are led out of the thermal shield 74 in a insulated state from the thermal shield 74 and are connected to first end portions of current leads 77*a* and 77*b* formed of, e.g. deoxidized phosphor copper. Connection portions between the current leads 76*a* and 76*b* and the current leads 77*a* and 77*b* are thermally connected to thermal anchors 78*a* and 78*b* of, e.g. aluminum nitride attached to the outer surface of the thermal shield 74. Second end portions of the current leads 77*a* and 77*b* are led to the outside via bushings penetrating the upper wall of the vacuum container 71. A heat conductive member 79 of copper is disposed on the superconducting coil 75, for example, such that the heat conductive member 79 is put in close contact with one axial end face of the coil 75.

A refrigerant-filled chamber type refrigerator 80 of a two-stage expansion structure is provided so as to penetrate the vacuum container 71 such that a part of the refrigerator 80 is located inside the container 71 and the other part thereof is located outside the container 71. The refrigerator 80 maintains the temperature environment of the superconducting coil 75. Specifically, the refrigerator 80 cools the thermal shield 74 to about 50 K and cools the superconducting coil 75 to about 5 K.

Figure 1:
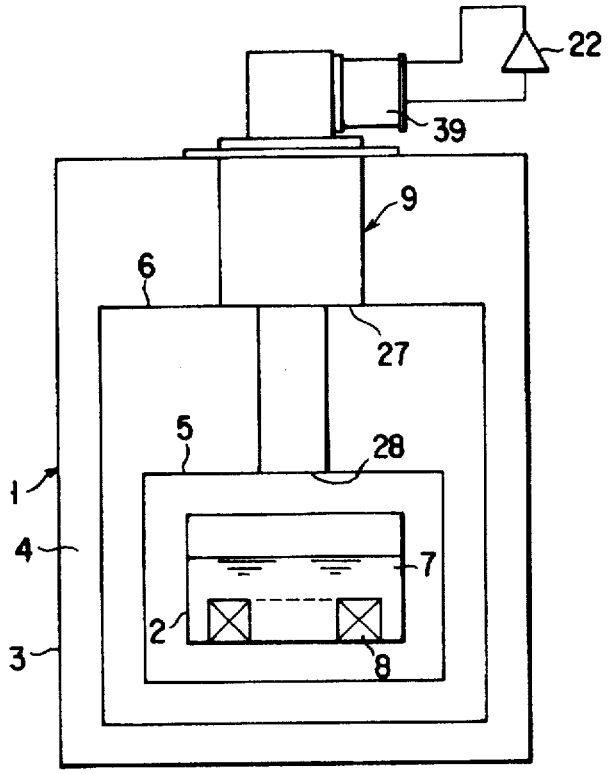
FIG. 1 PRIOR ART
FIG. 1 schematically shows the structure of a conventional superconducting magnet apparatus adopting an immersion cooling system.
Figure 2:
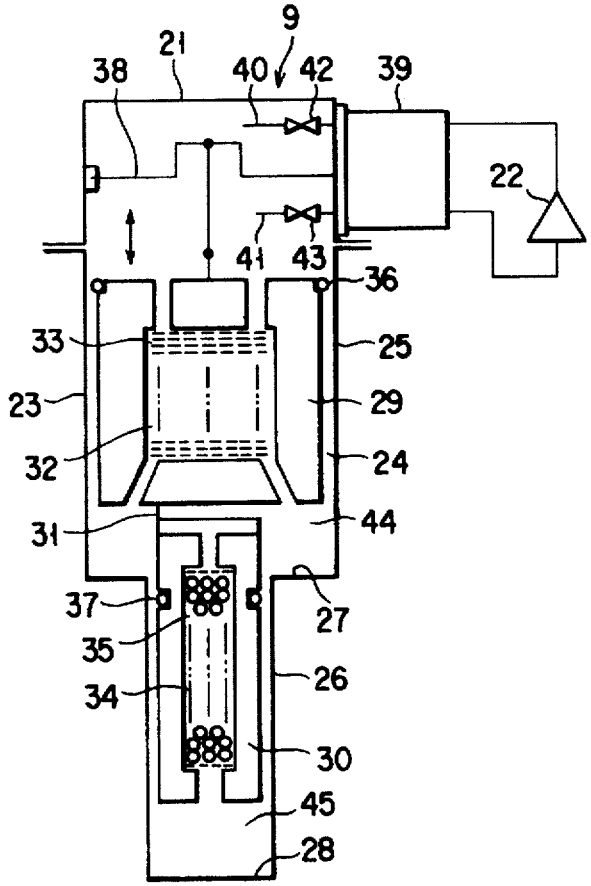
FIG. 2 PRIOR ART
FIG. 2 schematically shows the structure of a refrigerant-filled chamber type refrigerator built in the apparatus shown in FIG. 1.
Figure 3:
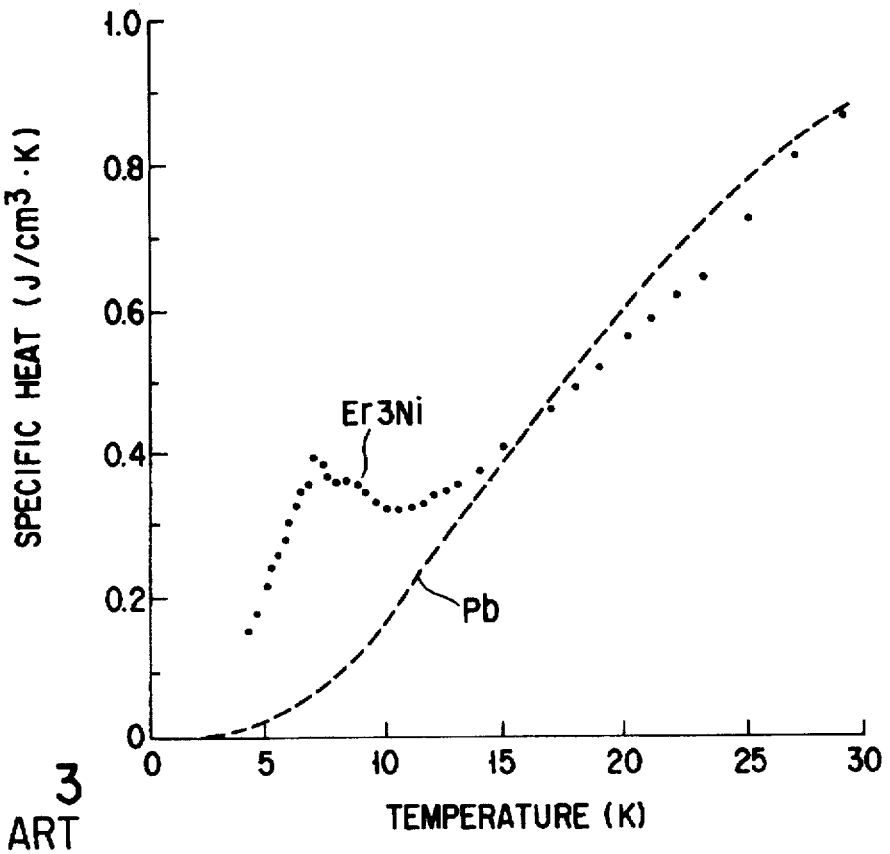
FIG. 3 PRIOR ART
FIG. 3 is a graph showing specific heat characteristics of a magnetic coldness-accumulating material which makes use of abnormal magnetic specific heat, etc. due to magnetic phase transition, in comparison with specific heat characteristics of lead.
Figure 4:
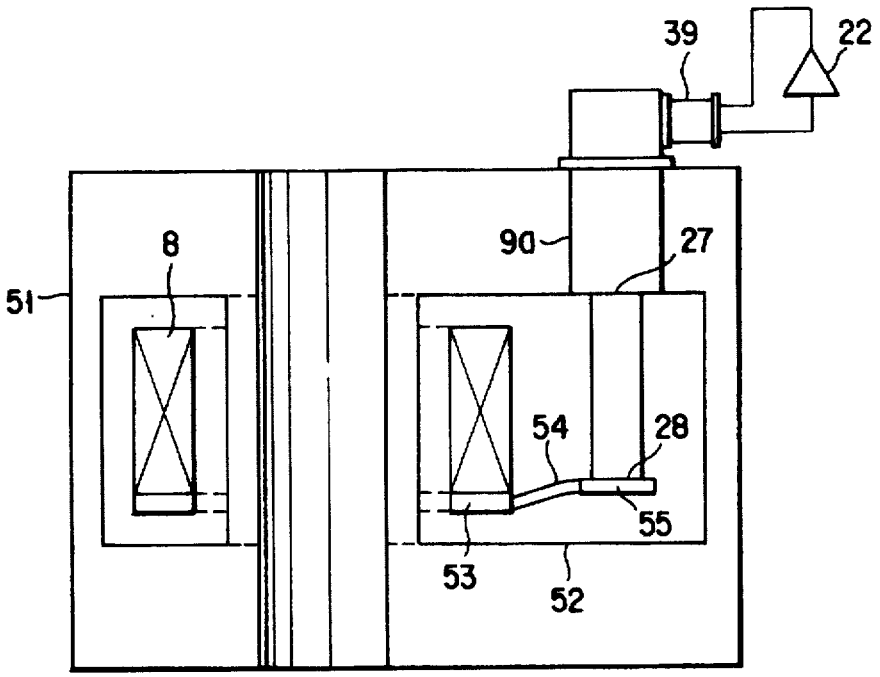
FIG. 4 PRIOR ART
FIG. 4 schematically shows the structure of a conventional superconducting magnet apparatus adopting a refrigerator direct cooling system.

The refrigerant-filled chamber type refrigerator 80 comprises a cold head 81 and a compressor 82. The cold head 81 comprises a first-stage refrigerating unit 83 and a second-stage refrigerant unit 84 connected in series to the first-stage refrigerating unit 83. The first-stage refrigerating unit 83 adopts the same Gifford-McMahon (GM) refrigeration cycle as shown in FIG. 2. The second-stage refrigerating unit 84 adopts a pulse tube refrigerating cycle.

The superconducting coil 75 or the main component of the superconducting magnet apparatus, the first-stage refrigerating unit 83 of the GM refrigerating cycle and the second-stage refrigerating unit 84 of the pulse tube refrigerating cycle are situated in a specific positional relationship. The positional relationship is determined on the basis of characteristics (shape, strength, use, etc.) of the superconducting coil and characteristics (shape, capacity, use, etc.) of each cooling stage. As is shown in FIG. 5, the direction of magnetic field generation of the superconducting coil 75 is substantially parallel to the axial directions of the first-stage refrigerating unit 83 of the GM refrigerating cycle and the second-stage refrigerating unit 84 of the pulse tube refrigerating cycle. In addition, the axial directions of the first-stage refrigerating unit 83 of the GM refrigerating cycle and the second-stage refrigerating unit 84 of the pulse tube refrigerating cycle are vertical. Accordingly, heat of the superconducting coil 75 located in the lower region is vertically absorbed by the multi-stage refrigerating units. Furthermore, a pulse tube of the second-stage refrigerating unit 84 is situated near the superconducting coil 75 on the side region of the coil 75.

The first-stage refrigerating unit 83 has a closed cylinder 85. A displacer 86 formed of a heat insulating material is reciprocally movably housed within the cylinder 85. The first-stage refrigerating unit 83 is provided with a first cooling stage 87 for generating coldness by expanding a compressed refrigerant gas at a head wall portion of the cylinder 85. The first cooling stage 87, more specifically, the outer surface of the head wall of the cylinder 85, is thermally connected to the thermal shield 74. The cylinder 85 is formed of a thin stainless steel plate, etc.

An axially extending fluid passage 88 for constituting a first-stage refrigerant-filled chamber is formed within the displacer 86. A coldness-accumulating material 89 of a mesh structure of, e.g. copper is contained within the fluid passage 88.

A sealing device 90 is provided between an upper portion of the outer peripheral surface of the displacer 86, i.e. a portion with a temperature near normal temperature, and the inner peripheral surface of the cylinder 85.

An upper end portion of the first displacer 86 is coupled to a rotary shaft of a motor 92 via a coupling rod, a scotch yoke or a crank shaft 91. If the motor 92 is rotated, the displacer 86 is reciprocally moved in synchronism with the rotation of the motor 92 in the vertical direction in FIG. 5.

An inlet 93 for introducing helium gas into the displacer 86 and an outlet 94 for exhausting the helium gas are provided in the upper space of the cylinder 85. The inlet 93 and outlet 94 are connected to the compressor 82 via a high-pressure valve 95 and a low-pressure valve 96 which are opened/closed in synchronism with the rotation of the motor 92. The compressor 82, high-pressure valve 95 and low-pressure valve 96 constitute a helium gas circulating system passing through the cylinder 85. Specifically, two operations are alternately performed: one operation being such that low-pressure (about 8 atm) helium gas is compressed by the compressor 82 and the pressurized helium gas (about 20 atm) is fed into the cylinder 85, the other being such that the helium gas is exhausted from the inside of the cylinder 85.

The second-stage refrigerating unit 84 is situated within the space defined by the thermal shield 74 and has the following structure. One end portion of a pipe 97 is connected to the head wall of the cylinder 85 so as to communicate with the inside of the cylinder 85. The other end portion of the pipe 97 is connected to one connection port of a second-stage refrigerant-filled chamber 98. The second-stage refrigerant-filled chamber 98 comprises a container 99 formed of a heat insulating material and a magnetic coldness-accumulating material 100 such as $Er_3Ni$, which makes use of, e.g. abnormal magnetic specific heat due to a magnetic phase transition. The other connection port of the second-stage refrigerant-filled chamber 98 is connected via an endothermic unit 101, which constitutes a second cooling stage, to one end portion of a pulse tube 102 having a greater diameter than the endothermic unit 101. The other end portion of the pulse tube 102 communicates with the pipe 97 via a capillary tube 103 and communicates via a capillary tube 104 with a buffer tank 105 provided between the thermal shield 74 and the upper wall of vacuum container 71. Specifically, the second-stage refrigerating unit 84 constitutes a pulse tube refrigerator adopting a double-inlet system. Although not shown, a higher-temperature side of the pulse tube 102 and the buffer tank 105 are thermally connected to the thermal shield 74 and cooled.

The endothermic unit 101 of the second cooling stage is thermally connected to a heat conductive block 106 formed of, e.g. a copper block. The heat conductive block 106 and the heat conductive member 79 are thermally coupled by a heat conductive material 107 of copper, etc.

The magnetic shield 108 prevents a magnetic field generated by the superconducting coil 75 from adversely affecting the operation of the motor 92. FIG. 5 does not show position holding means for the superconducting coil 75 and thermal shield 74.

The operation of the superconducting magnet apparatus with the above structure in the driving mode, in particular, the operation for maintaining the temperature environment of the superconducting coil 75, will now be described.

Coldness necessary for maintaining the temperature environment of the superconducting coil 75 is generated by the first cooling stage 87 and the endothermic unit 101 constituting the second cooling stage. The first cooling stage 87 is cooled down to about 30 K in an ideal condition with no thermal load. The endothermic unit 101 is cooled down to about 4 K. Accordingly, a temperature gradient between normal temperature (300 K) and 30 K is provided between the upper and lower ends of the displacer 86, and a temperature gradient between 30 K and 4 K is provided between the upper and lower ends of the refrigerant-filled chamber 84 (i.e. the upper and lower ends of the pulse tube 102).

When the motor 92 starts to rotate, the displacer 86 reciprocally moves between the bottom dead point (the highest point in FIG. 5) and the top dead point (the lowest point in FIG. 5). When the displacer 86 has reached the top dead point, the high-pressure valve 95 opens and the high-pressure helium gas enters the cylinder 85. The sealing device 90 is provided between the outer peripheral surface of the displacer 86 and the inner peripheral surface of the cylinder 85. Accordingly, the incoming high-pressure helium gas flows through the fluid passage 88 defined in the displacer 86 to the pulse tube 102 via the refrigerant-filled chamber 98. While the high-pressure helium gas flows to the pulse tube, it is cooled by the coldness-accumulating material 89 to about 50 K and then cooled by the magnetic coldness-accumulating material 100 to about 5 K.

When the displacer 86 has reached the bottom dead point, the high-pressure valve 95 is closed and the low-pressure valve 96 is opened. If the low-pressure valve 96 is opened, the high-pressure helium gas in a space 109 between the displacer 86 and the head wall of the cylinder 85 adiabatically expands and generates coldness. By the generated coldness, the first cooling stage 87 absorbs external heat from the thermal shield 74. As a result, the thermal shield 74 is cooled down to about 50 K.

On the other hand, if the low-pressure valve 96 is opened, the high-pressure helium gas in the pulse tube 102 adiabatically expands and generates coldness. By the generated coldness, the endothermic unit 101 constituting the second cooling stage absorbs external heat from the superconducting coil 75 via the heat conductive block 106, heat conductive material 107 and heat conductive member 79. As a result, the superconducting coil 75 is cooled down to about 5 K which is lower than the critical temperature.

As the displacer 86 begins to move toward the top dead point once again, the low-temperature helium gas in the pulse tube 102 flows reversely into the second-stage refrigerant-filled chamber 98. The reverse flow of the low-temperature helium gas cools the magnetic coldness-accumulating material 100. The low-temperature helium gas in the space 109 passes through the fluid passage 88 while cooling the coldness-accumulating material 89. Accordingly, the helium gas heated approximately up to the normal temperature rises to the upper space of the cylinder 85, and this gas is exhausted to the compressor 82 via the low-pressure valve 96. The capillary tubes 103 and 104 and buffer tank 105 contribute to efficient coldness generation by adjusting the relationship in phase between the pressure variation and displacement of gas in the pulse tube refrigerating cycle constituting the second-stage refrigerating unit 84.

The above-described cycle is repeated to maintain the temperature environment of the superconducting coil 75. Thus, the superconducting coil 75 is kept at about 5 K which is lower than the critical temperature, and the thermal shield 74 is kept at about 50 K at which heat due to radiation is prevented from entering the superconducting coil 75.

As has been described above, the superconducting magnet apparatus of the refrigerator direct cooling system according to the present embodiment has the two-stage expansion structure. Specifically, the refrigerant-filled chamber type refrigerator 80 for maintaining the temperature environment of the superconducting coil 75 comprises the first-stage refrigerating unit 83 adopting the GM refrigerating cycle and second-stage refrigerating unit 84 adopting the pulse tube refrigerating cycle. The first-stage refrigerating unit 83 is situated on the high-temperature side, and the second-stage refrigerating unit 84 is situated on the low-temperature side (final-stage side).

The second-stage refrigerating unit 84 adopting the pulse tube refrigerating cycle requiring no movable element, i.e. no sliding seal element is situated in the final stage, the temperature condition for which is severest. Thus, the refrigeration power of the second cooling stage is prevented from deteriorating due to the presence of the sliding seal element, and the operation for maintaining the temperature environment can be stably performed for a long time.

The second-stage (last-stage) refrigerating unit 84 adopts the pulse tube refrigerating cycle requiring no movable element. Thus, when the magnetic coldness-accumulating material 100 which makes use of, e.g. abnormal magnetic specific heat due to a magnetic phase transition is used as coldness-accumulating material of the refrigerant-filled chamber 89 of the final stage, the refrigerant-filled chamber 89 may be provided such that the magnetic coldness-accumulating material 100 can withstand the force of a magnetic field generated by the superconducting coil 75. Accordingly, this force does not influence the mechanical movement or coldness generation of the refrigerant-filled chamber type refrigerator 80. Furthermore, the refrigeration power is prevented from deteriorating due to the force of magnetic field generated by the superconducting coil 75, which may act on the magnetic coldness-accumulating material 100. Since the magnetic coldness-accumulating material 100 within the refrigerant-filled chamber 98 is always in the static state, the magnetic coldness-accumulating material 100 causes no magnetic noise in the magnetic field generated by the superconducting coil 75.

Besides, the superconducting magnet apparatus with desirable structure can be provided. With this structure, the direction of magnetic field generation of the superconducting coil 75 is substantially parallel to the axial directions of the first-stage refrigerating unit 83 of the GM refrigerating cycle and the second-stage refrigerating unit 84 of the pulse tube refrigerating cycle, and the pulse tube 102 of the second-stage refrigerating unit 84 is situated near the superconducting coil 75. The heat of the superconducting coil 75 is absorbed and efficiently removed by the vertically arranged multi-stage refrigerating units 83 and 84.

As has been described above, this embodiment provides a superconducting magnet apparatus of a refrigerator direct cooling system, which has a desirable structure and can prevent the superconducting coil 75 from being quenched due to a cause in the temperature environment maintaining system for a long time period.

Figure 6:
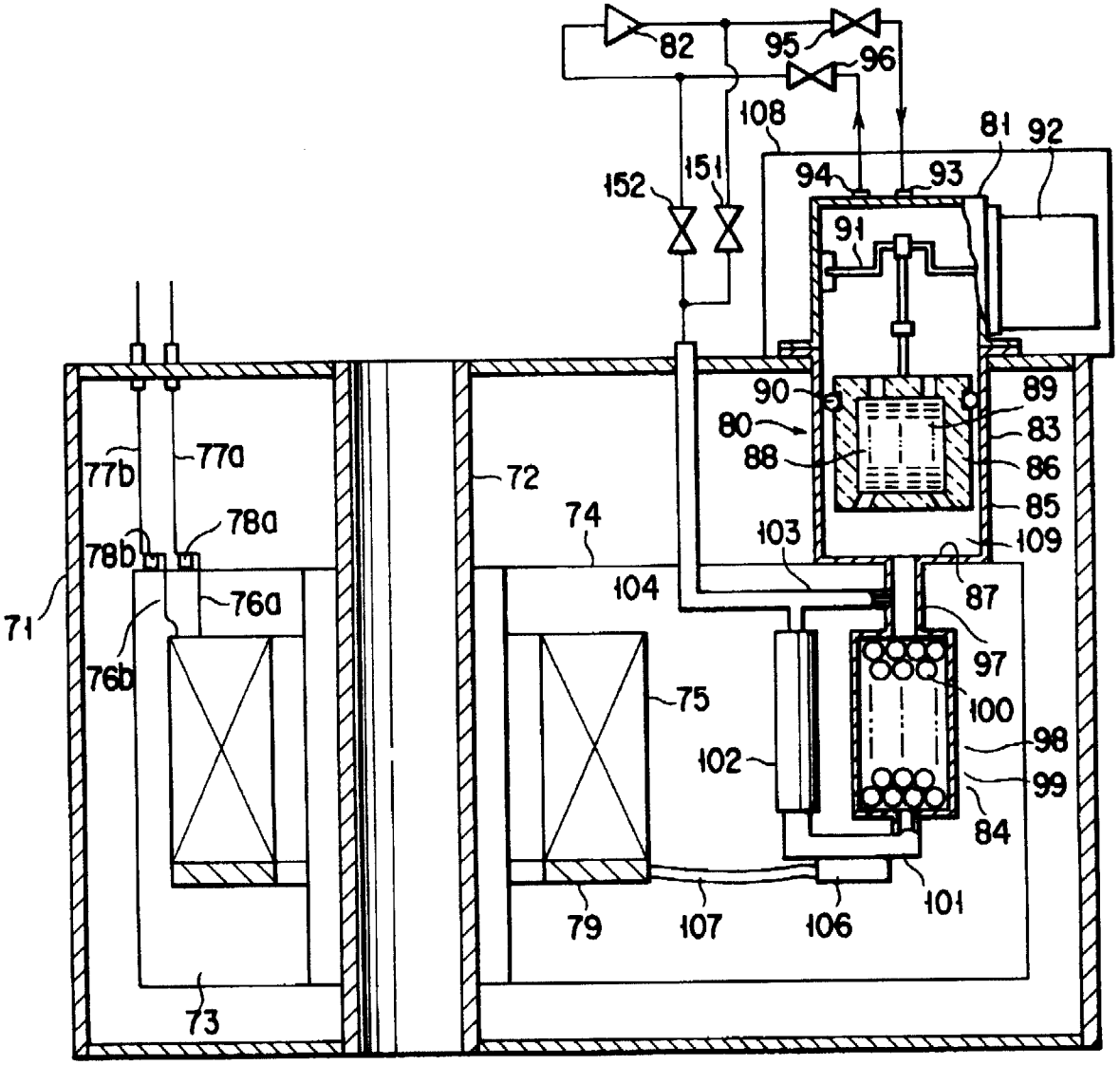
FIG. 6 schematically shows the structure of a superconducting magnet apparatus according to another embodiment of the present invention.

FIG. 6 shows a superconducting magnet apparatus of the refrigerator direct cooling system according to another embodiment of the invention. The functional parts common to those in FIG. 5 are denoted by like reference numerals, and a detailed description thereof is omitted.

The main components of the superconducting magnet apparatus of this embodiment have the same structures as those in the preceding embodiment. However, the valve mechanism in this embodiment has a function of increasing the coldness generation amount in the final cooling stage by providing a predetermined phase difference between the phase of pressure variation in the final cooling stage, which is the pulse tube refrigerator, and the phase of displacement of gas.

This embodiment differs mainly from the embodiment of FIG. 5 with respect to the structure of a phase control mechanism of the pulse tube refrigerator constituting the second cooling stage. The phase control mechanism is a part of the valve mechanism. Specifically, the apparatus shown in FIG. 6 includes a four-valve phase control mechanism. The four-valve phase control mechanism mainly comprises a low-pressure valve 96, a compressor 82, a high-pressure valve 95, an auxiliary high-pressure valve 151 and an auxiliary low-pressure valve 152. In a gas control system of the four-valve phase control mechanism, the outlet 94 is connected to the inlet 93 via the low-pressure valve 96, compressor 82 and high-pressure valve 95. A gas discharge end portion of the compressor 82 is connected via the auxiliary high-pressure valve 151 to an end portion of the capillary tube 104, which projects to the normal-temperature region. A gas suction end portion of the compressor 82 is connected via the auxiliary low-pressure valve 152 to the end portion of the capillary tube 104, which projects to the normal-temperature region. The low-pressure valve 96 and high-pressure valve 95 are synchronized with the rotation of the motor 92 and are opened/closed in relation to the volume (varying in a range of 0 to vmax) of the first expansion chamber defined in the cylinder 85 in a manner illustrated in FIG. 7. The auxiliary high-pressure valve 151 and auxiliary low-pressure valve 152 serve to set a predetermined phase difference between the phase of pressure variation in the pulse tube refrigerator, which constitutes the second cooling stage, and the phase of displacement of gas. The auxiliary high-pressure valve 151 and auxiliary low-pressure valve 152 are similarly opened/closed in synchronism with the rotation of the motor 92 in the manner illustrated in FIG. 7.

Figure 7:
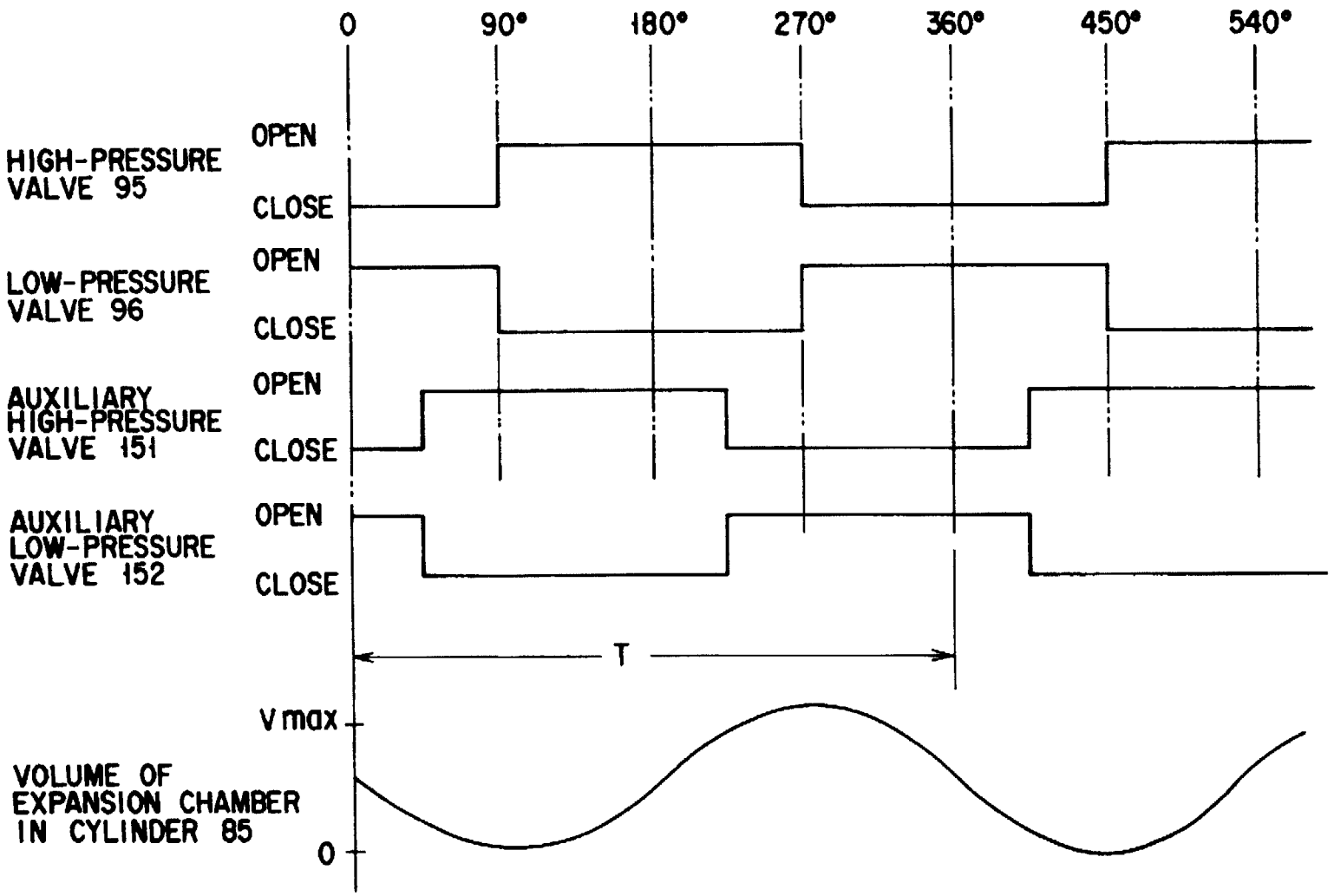
FIG. 7 shows the opening/closing timing of phase control valves built in a refrigerator shown in FIG. 6.

In this embodiment, the auxiliary high-pressure valve 151 and auxiliary low-pressure valve 152 for supplying high-pressure helium gas to the portion of the capillary tube 104 projecting to the normal-temperature region and for exhausting the helium gas therefrom are provided in order to increase the coldness generation amount in the second cooling stage 101 by providing a predetermined phase difference between the phase of pressure variation in the pulse tube 102 and the phase of displacement of gas. The auxiliary high-pressure valve 151 and auxiliary low-pressure valve 152 are opened/closed in synchronism with the reciprocal movement of the displacer 86. Specifically, as shown in FIG. 7, the auxiliary high-pressure valve 151 is opened/closed at a timing earlier than the high-pressure valve 95, and the auxiliary low-pressure valve 152 is opened/closed at a timing earlier than the low-pressure valve 96. By this control, the coldness generation amount at the second cooling stage 106 can be increased.

In this embodiment, a coldness-accumulating material is contained in the capillary tube 104, thereby to prevent normal-temperature helium gas from entering the body of the pulse tube 102 via the auxiliary high-pressure valve 151. Thus, the coldness-accumulating material prevents the entrance of heat from the normal-temperature region and allows a helium gas at a temperature substantially equal to the temperature of the first cooling stage 87 to flow into the high-temperature end portion of the body of the pulse tube 102.

In the above structure, the high-temperature end portion of the pulse tube 102 of the pulse tube refrigerator is substantially located in the normal-temperature region. Thus, a phase control mechanism necessary for the pulse tube refrigerator can easily be provided, and the coldness generation amount in the pulse tube 102 can be increased. Therefore, the refrigeration power can remarkably be enhanced. In other words, since the phase control mechanism is provided in the normal-temperature region, the operability, reliability and easiness of maintenance of valves, etc. can remarkably be enhanced.

Figure 8:
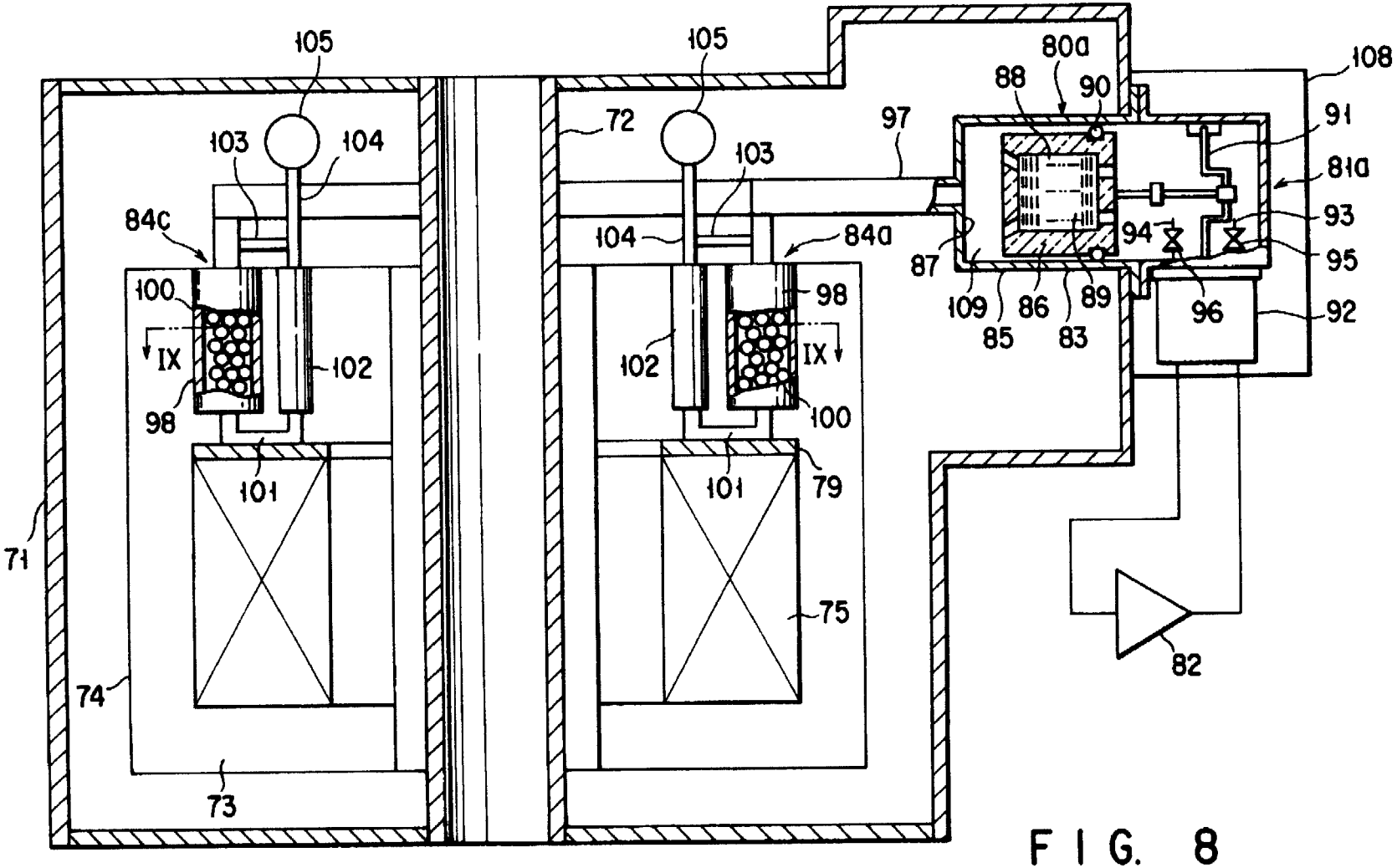
FIG. 8 schematically shows the structure of a superconducting magnet apparatus according to still another embodiment of the present invention.

FIG. 8 shows a superconducting magnet apparatus of the refrigerator direct cooling system according to another embodiment of the invention. The functional parts common to those in FIG. 5 are denoted by like reference numerals, and a detailed description thereof is omitted.

This embodiment differs mainly from the embodiment of FIG. 5 with respect to the structure of a refrigerant-filled chamber type refrigerator **80*a* and the structure for cooling the superconducting coil 75**.

The refrigerant-filled chamber type refrigerator **80*a* comprises a first-stage refrigerating unit 83 and four second-stage refrigerating units 84*a* to 84*d* (see FIG. 9) branched from the first-stage refrigerating unit 83**.

Like the first-stage refrigerating unit of the refrigerant-filled chamber type refrigerator shown in FIG. 5, the first-stage refrigerating unit 83 adopts the Gifford-McMahon (GM) refrigeration cycle wherein the refrigerant-filled chamber is movable. Although the four second-stage refrigerating units **84*a* to 84*d* branched, each branched system adopts, like the second-stage refrigerating unit of the refrigerant-filled chamber type refrigerator shown in FIG. 5, an orifice double-inlet type pulse tube refrigerating cycle comprising a second-stage refrigerant-filled chamber 98 containing a magnetic coldness-accumulating material 100 such as $Er_3Ni$, which makes use of, e.g. abnormal magnetic specific heat due to a magnetic phase transition, an endothermic unit 101 constituting the second cooling stage, capillary tubes 103 and 104, and a buffer tank 105**.

Figure 9:
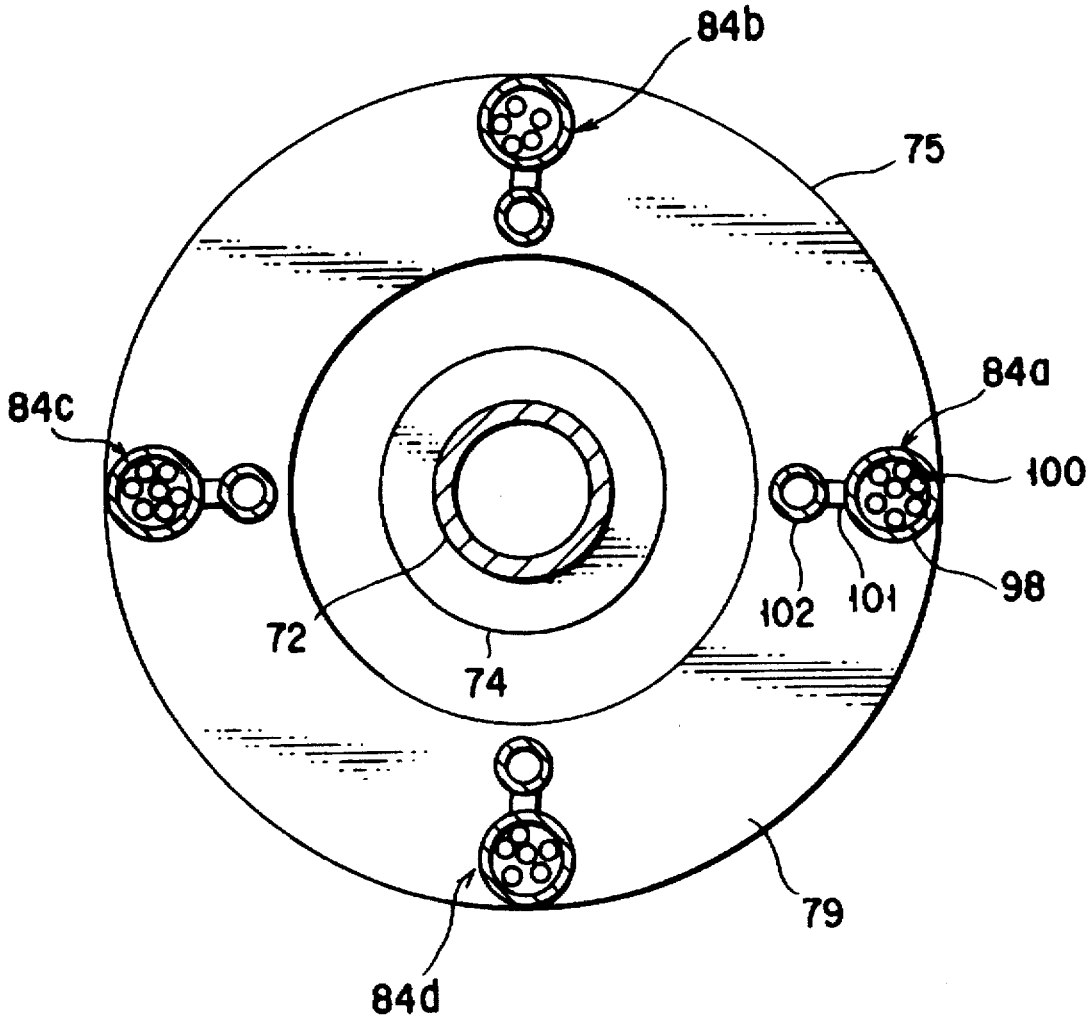
FIG. 9 is a cross-sectional view taken along line IX—IX in FIG. 8.

The second-stage refrigerating units **84*a* to 84*d*, as shown in FIG. 9, have the same structure including dimensions of each part. The second-stage refrigerating units 84*a* and 84*d* are arranged around the axis of the superconducting coil 75 at an angular interval of 90°, with the same attitude toward the axis of the coil 75. The endothermic unit 101 of each of the second-stage refrigerating units 84*a* to 84*d* is thermally connected to the heat conductive member 79 attached to the end face of the superconducting coil 75**.

FIG. 8 does not show a current lead for supplying current to the superconducting coil 75 from the outside, the support structure for the superconducting coil 75, etc.

With the above structure, the superconducting coil 75 can stably be cooled on the basis of the same principle as the apparatus shown in FIG. 5, and the same advantage as the apparatus shown in FIG. 5 can be obtained.

In this embodiment, the static type second-stage refrigerating unit of the refrigerant-filled chamber type refrigerator **80*a* is branched to four units 84*a* to 84*d*, and the four second-stage refrigerating units 84*a* to 84*d* are arranged equidistantly around the axis of the superconducting coil 75. In addition, the endothermic unit 101 or the cooling stage of each of the second-stage refrigerating units 84***a* to 84*d* is thermally connected to the superconducting coil 75 with the heat conductive member 79 interposed. Thus, the superconducting coil 75 can be uniformly cooled so that no temperature difference occurs in the coil 75. Furthermore, since the second-stage refrigerating units 84*a* to 84*d* are arranged equidistantly around the axis of the superconducting coil 75 to cool the superconducting coil 75, the magnetic coldness-accumulating material 100 does not disturb the symmetry of magnetic field generated by the superconducting coil 75, even if the material 100 is used in each of the refrigerant-filled chambers 98 of the second-stage refrigerating units 84*a* to 84*d*. Therefore, a correcting operation for enhancing symmetry can be easily performed.

Figure 10:
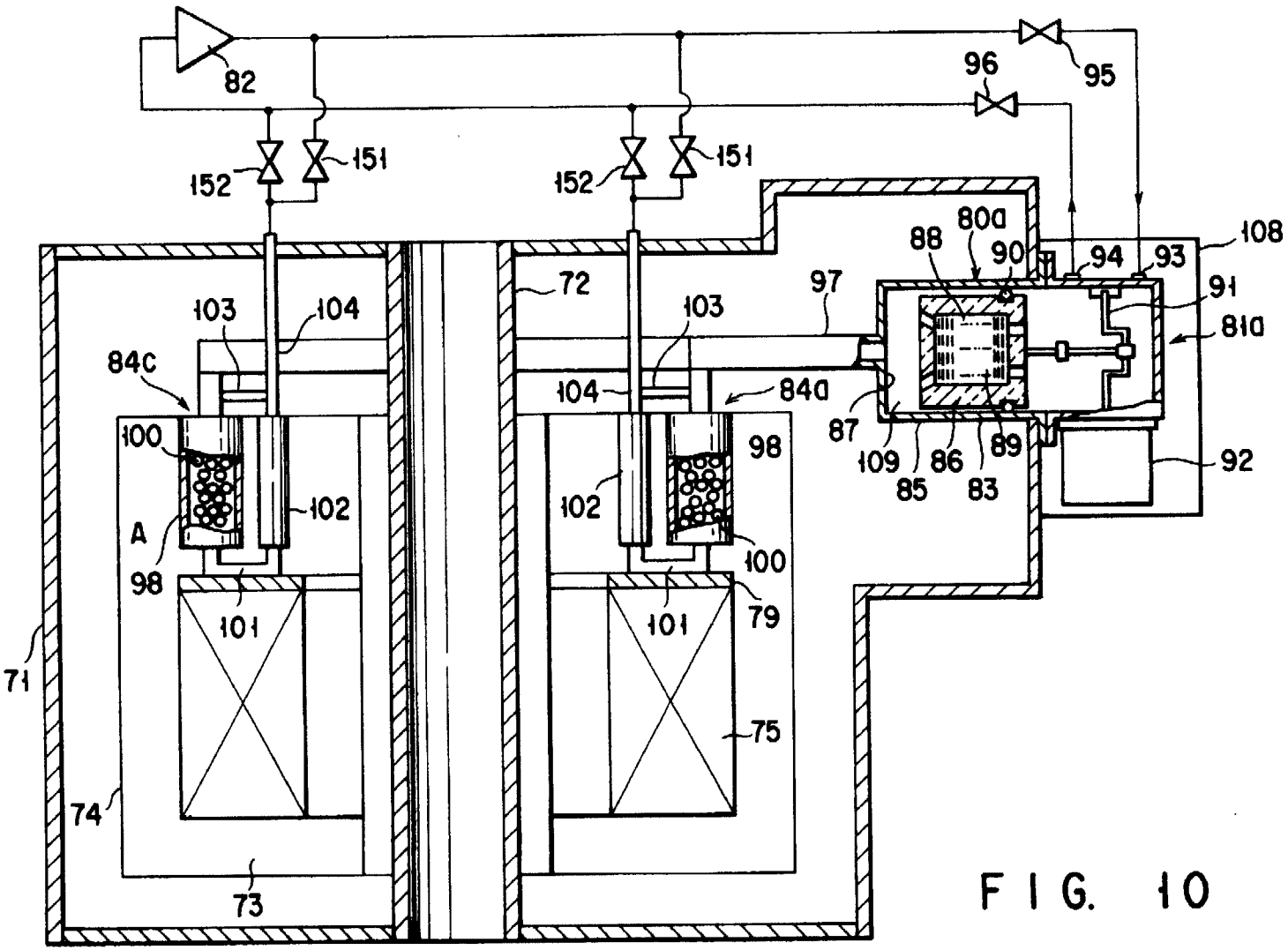
FIG. 10 schematically shows the structure of a superconducting magnet apparatus according to still another embodiment of the present invention.

FIG. 10 shows a superconducting magnet apparatus of the refrigerator direct cooling system according to another embodiment of the invention. The functional parts common to those in FIG. 8 are denoted by like reference numerals, and a detailed description thereof is omitted.

This embodiment differs mainly from the embodiment of FIG. 8 with respect to the structure of a phase control mechanism of the pulse tube refrigerator constituting the second cooling stage. Specifically, the apparatus shown in FIG. 10 includes a four-valve phase control mechanism. The four-valve phase control mechanism mainly comprises a low-pressure valve 96, a compressor 82, a high-pressure valve 95, a plurality of auxiliary high-pressure valves 151 and a plurality of auxiliary low-pressure valves 152. In a gas control system of the four-valve phase control mechanism, the outlet 94 is connected to the inlet 93 via the low-pressure valve 96, compressor 82 and high-pressure valve 95. A gas discharge end portion of the compressor 82 is connected via the auxiliary high-pressure valves 151 to end portions of the capillary tubes 104, which project to the normal-temperature region. A gas suction end portion of the compressor 82 is connected via the auxiliary low-pressure valves 152 to the end portions of the capillary tubes 104, which project to the normal-temperature region. The low-pressure valve 96 and high-pressure valve 95 are synchronized with the rotation of the motor 92 and are opened/closed in relation to the volume (varying in a range of 0 to Vmax) of the first expansion chamber defined in the cylinder 85 in the manner illustrated in FIG. 7. The auxiliary high-pressure valves 151 and auxiliary low-pressure valves 152 serve to set a predetermined phase difference between the phase of pressure variation in the pulse tube refrigerator, which constitutes the second cooling stage, and the phase of displacement of gas. The auxiliary high-pressure valves 151 and auxiliary low-pressure valves 152 are similarly opened/closed in synchronism with the rotation of the motor 92 in the manner illustrated in FIG. 7.

In this embodiment, the auxiliary high-pressure valves 151 and auxiliary low-pressure valves 152 for supplying high-pressure helium gas to the portions of the capillary tubes 104 projecting to the normal-temperature region and for exhausting the helium gas therefrom are provided in order to increase the coldness generation amount in the second cooling stage 101 by providing a predetermined phase difference between the phase of pressure variation in the pulse tube 102 and the phase of displacement of gas. The auxiliary high-pressure valves 151 and auxiliary low-pressure valves 152 are opened/closed in synchronism with the reciprocal movement of the displacer 86. Specifically, as shown in FIG. 7, the auxiliary high-pressure valves 151 are opened/closed at a timing earlier than the high-pressure valve 95, and the auxiliary low-pressure valves 152 are opened/closed at a timing earlier than the low-pressure valve 96. By this control, the coldness generation amount at the second cooling stage 106 can be increased.

In this embodiment, each of the branched second-stage refrigerating units 84*a* to 84*d* is provided with the four-valve phase control mechanism mainly comprising the low-pressure valve 96, compressor 82, high-pressure valve 95, auxiliary high-pressure valves 151 and auxiliary low-pressure valves 152. By totally or individually controlling the four-valve phase control mechanisms for the second-stage refrigerating units 84*a* to 84*d*, the temperature of the super-conducting coil 75 can be controlled more precisely. This contributes to the uniform cooling of the superconducting coil 75 with no control difference.

In this embodiment, a coldness-accumulating material is contained in each capillary tube 104, thereby to prevent normal-temperature helium gas from entering the body of the associated pulse tube 102 via the associated auxiliary high-pressure valve 151. Thus, the coldness-accumulating material prevents the entrance of heat from the normal-temperature region and allows a helium gas at a temperature substantially equal to the temperature of the first cooling stage 87 to flow into the high-temperature end portion of the body of the associated pulse tube 102.

In the above structure, the high-temperature end portion of each pulse tube 102 of the pulse tube refrigerator is substantially located in the normal-temperature region. Thus, a phase control mechanism necessary for the pulse tube refrigerator can easily be provided, and the coldness generation amount in the pulse tube 102 can be increased. Therefore, the refrigeration power can remarkably be enhanced. In other words, since the phase control mechanism is provided in the normal-temperature region, the operability, reliability and easiness of maintenance of valves, etc. can remarkably be enhanced.

Figure 11:
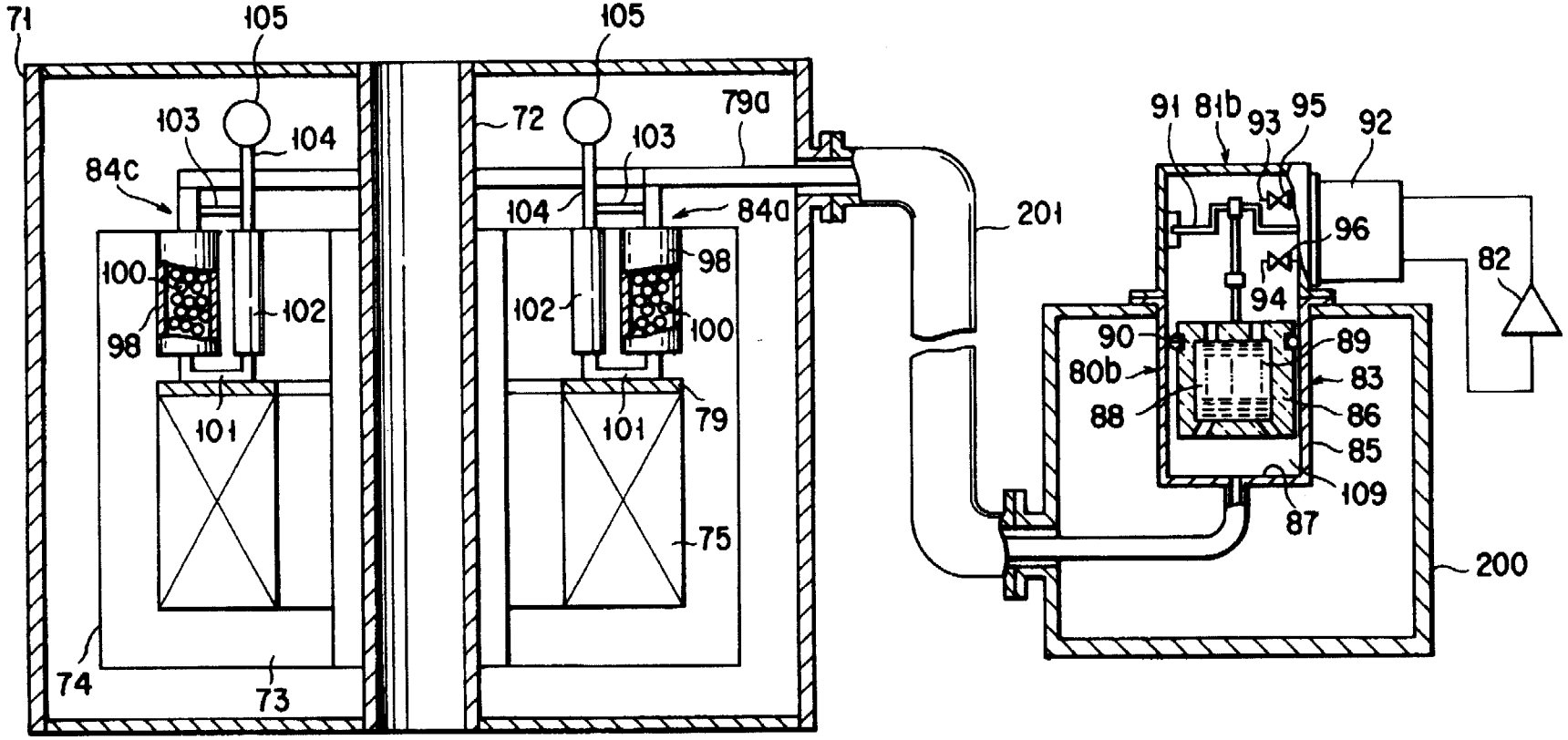
FIG. 11 schematically shows the structure of a superconducting magnet apparatus according to still another embodiment of the present invention.

FIG. 11 shows a superconducting magnet apparatus of the refrigerator direct cooling system according to another embodiment of the invention. The functional parts common to those in FIG. 8 are denoted by like reference numerals, and a detailed description thereof is omitted.

This embodiment differs mainly from the embodiment shown in FIG. 8 with respect to the structure of a refrigerant-filled chamber type refrigerator 80*b*.

In this embodiment, too, the refrigerant-filled chamber type refrigerator 80*b* comprises a first-stage refrigerating unit 83 and four second-stage refrigerating units 84*a* to 84*d* branched from the first-stage refrigerating unit 83. However, the first-stage refrigerating unit 83 is connected to the second-stage refrigerating units 84*a* to 84*d* via a long pipe 79*a*. Thereby, the second-stage refrigerating units 84*a* to 84*d* are contained within a vacuum container 71 and the first-stage refrigerating unit 83 is contained within another vacuum container 200 designed exclusively for the refrigerator. In FIG. 11, numeral 201 denotes an insulating pipe for vacuum-heat-insulating the pipe 79*a*. It is desirable that the insulating pipe 201 has a flexible structure which does not easily transmit mechanical vibration. An example of the flexible insulating pipe 201 is a bellows-type pipe. FIG. 11 does not show a current lead for supplying current to the superconducting coil 75 from the outside, the support structure for the superconducting coil 75, etc.

With the above structure, the superconducting coil 75 can stably be cooled on the basis of the same principle as the apparatus shown in FIG. 8, and the same advantage as the apparatus shown in FIG. 8 can be obtained.

In this embodiment, the static type second-stage refrigerating units 84*a* to 84*d* of the refrigerant-filled chamber type refrigerator 80b are disposed within the vacuum container 71 in which the superconducting coil 75 is housed. The first-stage refrigerating unit 83 is contained within the other vacuum container 200 designed exclusively for the refrigerator. The first-stage refrigerating unit 83 is connected to the second-stage refrigerating units 84*a* to 84*d* via the long pipe 79*a* and the insulating pipe 201 which does not easily transmit mechanical vibration. It is possible, therefore, to prevent mechanical vibration of the movable first-stage refrigerating unit 83 from being directly transmitted to the superconducting coil 75. Accordingly, it is possible to avoid the occurrence of a problem due to mechanical vibration transmitted to the superconducting coil, for example, fluctuation of magnetic field. Therefore, this embodiment is applicable to SQUID or NMR which is susceptible to mechanical noise or magnetic noise.

Figure 12:
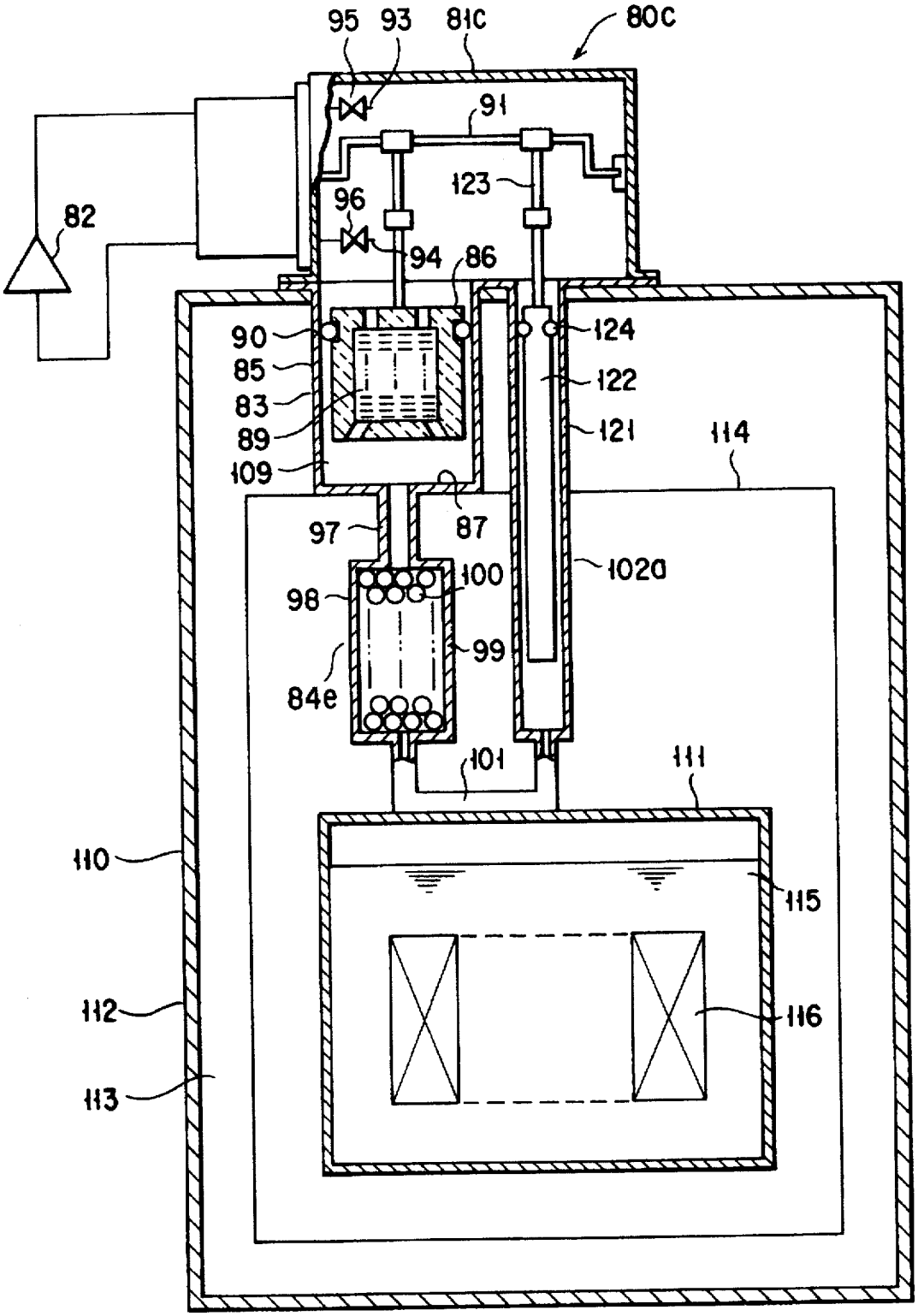
FIG. 12 schematically shows the structure of a superconducting magnet apparatus according to still another embodiment of the present invention.

FIG. 12 shows a superconducting magnet apparatus of an immersion cooling system according to another embodiment of the present invention. In the superconducting magnet apparatus shown in FIGS. 5 to 11, the superconducting coils are directly cooled by the refrigerators. In this embodiment and the following embodiment shown in FIG. 13, however, an inner bath containing liquid helium and a superconducting coil is cooled by a refrigerator.

In FIG. 12, the functional parts common to those in FIG. 5 are denoted by like reference numerals, and a detailed description thereof is omitted.

As is shown in FIG. 12, the direction of magnetic field generation of a superconducting coil 116 is substantially parallel to the axial direction of multi-stage refrigerating units 83 and 84*e*. In addition, the axial directions of the first-stage refrigerating unit 83 and second-stage refrigerating unit 84*e* are vertical. Accordingly, heat of an inner bath 111 containing the superconducting coil 75 located in the lower region is vertically absorbed by the multi-stage refrigerating units 83 and 84*e*.

In FIG. 12, a heat-insulating container 110 comprises the inner bath 111, an outer bath 112, a vacuum heat-insulating layer 113 defined between the inner bath 111 and outer bath 112, and a thermal shield 114 surrounding the inner bath 111 within the vacuum heat-insulating layer 113. Liquid helium 115 or a cryogenic refrigerant is contained within the inner bath 111. The superconducting coil 116 is situated such that it is immersed in the liquid helium 115. For the purpose of simplicity, FIG. 12 does not show a current lead for supplying from the outside a current to the superconducting coil 116, a liquid injection pipe for injecting the liquid helium 115 into the inner bath 111, etc.

A refrigerant-filled chamber type refrigerator 80*c* of a two-stage expansion structure is provided so as to penetrate the heat-insulating container 110 such that a part of the refrigerator 80c is located inside the container 110 and the other part thereof is located outside the container 110. The refrigerator 80*c* maintains the temperature environment of the superconducting coil 116. Specifically, the refrigerator 80*c* cools the thermal shield 114 to about 50 K and cools the inner bath 111 to about 4 K.

The refrigerant-filled chamber type refrigerator 80*c*, like the refrigerator shown in FIG. 5, comprises a cold head 81*c* and a compressor 82. The cold head 81*c*, like the cold head shown in FIG. 5, basically comprises a first-stage refrigerating unit 83 and a second-stage refrigerating unit 84*e* connected in series to the first-stage refrigerating unit 83. The first-stage refrigerating unit 83 adopts a Gifford-McMahon (GM) refrigeration cycle, and the second-stage refrigerating unit 84*e* adopts a pulse tube refrigerating cycle.

In the refrigerant-filled chamber type refrigerator 80*c*, a first-stage cooling stage 87 provided on the first-stage refrigerating unit 83 cools the thermal shield 114 to about 50 K, and an endothermic unit 101 serving as second cooling stage cools the inner bath 111 to about 4 K.

The refrigerant-filled chamber type refrigerator 80*c* built in the superconducting magnet apparatus of this embodiment differs from the refrigerant-filled chamber type refrigerator 80 built in the superconducting magnet apparatus shown in FIG. 5 with respect to the structure of a pulse tube 102*a* constituting a part of the second-stage refrigerating unit 84*e*.

Specifically, the pulse tube 102*a* comprises a pulse tube body 121 and a piston 122. The pulse tube body 121 is formed of a heat insulating material and has one end portion communicating with the endothermic unit 101 and the other end portion communicating with an upper space of the cylinder 85. The piston 122 is formed of a heat insulating material and is reciprocally movably housed in the pulse tube body 121. An upper end portion (in FIG. 12) of the piston 122 is coupled to a crank shaft 91 via a coupling mechanism 123 such as a coupling rod or a scotch yoke. A sealing device 124 is provided between an upper portion (in FIG. 12) of the outer peripheral surface of the piston 122, i.e. a portion with a temperature near normal temperature, and the inner peripheral surface of the pulse tube body 121, thereby ensuring sealing between the outer peripheral surface of the piston 122 and the inner peripheral surface of the pulse tube body 121.

As is understood from the above-described structure, in the refrigerant-filled chamber type refrigerator 80*c* built in the superconducting magnet apparatus of this embodiment, the volume of the pulse tube 102*a* is varied in synchronism with reciprocal movement of the displacer 86. Thereby, a phase difference between the pressure variation in the second-stage refrigerating unit 84*e* and the gas flow is determined.

In this superconducting magnet apparatus of immersion cooling system according to this embodiment, too, the second-stage refrigerating unit 84e adopting the pulse tube refrigerating cycle requiring no movable element, i.e. no sliding seal element is situated on the low-temperature side, the temperature condition for which is severest. Thus, the refrigeration power of the second cooling stage is prevented from deteriorating due to the presence of the sliding seal element, and the operation for maintaining the temperature environment can be stably performed for a long time. Therefore, the same advantage as with the apparatus shown in FIG. 5 can be obtained.

Figure 13:
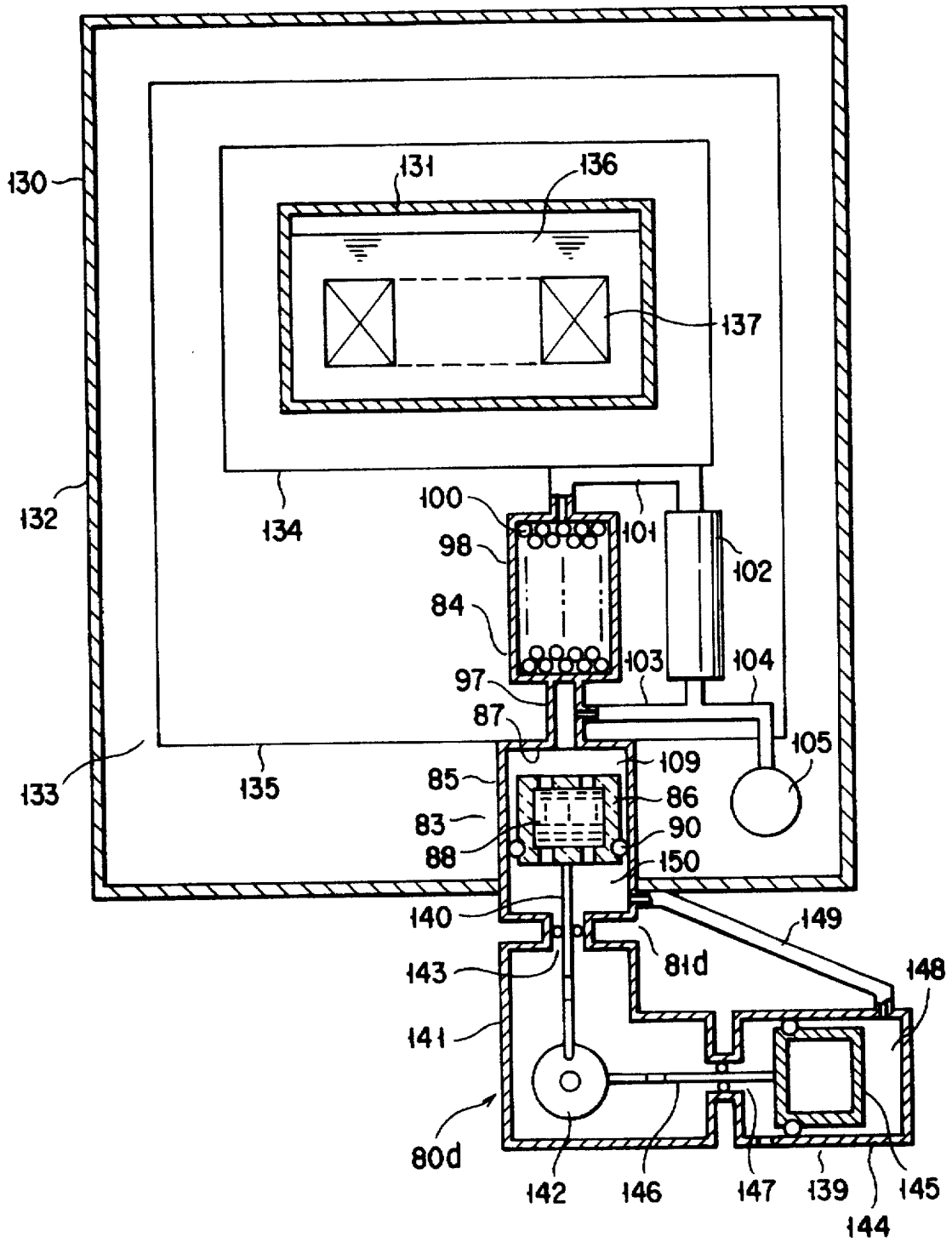
FIG. 13 schematically shows the structure of a superconducting magnet apparatus according to still another embodiment of the present invention.

FIG. 13 shows a superconducting magnet apparatus of an immersion cooling system according to another embodiment of the present invention. In FIG. 12, the functional parts common to those in FIG. 5 are denoted by like reference numerals, and a detailed description thereof is omitted.

As is shown in FIG. 13, the direction of magnetic field generation of a superconducting coil 137 is substantially parallel to the axial direction of multi-stage refrigerating units 83 and 84. In addition, the axial directions of the first-stage refrigerating unit 83 and second-stage refrigerating unit 84 are vertical. Accordingly, heat of an inner bath 131 containing the superconducting coil 137 located in the upper region is absorbed vertically downward by the multi-stage refrigerating units 83 and 84.

In FIG. 13, numeral 130 denotes a heat-insulating container. The heat-insulating container 130 comprises the inner bath 131, an outer bath 132, a vacuum heat-insulating layer 133 defined between the inner bath 131 and outer bath 132, and thermal shields 134 and 135 surrounding the inner bath 131 within the vacuum heat-insulating layer 133. Liquid helium 136 or a cryogenic refrigerant is contained within the inner bath 131. The superconducting coil 137 is situated such that it is immersed in the liquid helium 136. For the purpose of simplicity, FIG. 13 does not show a current lead for supplying from the outside a current to the superconducting coil 137, a liquid injection pipe for injecting the liquid helium 136 into the inner bath 131, or an exhaust pipe for recovering the helium gas generated by evaporation.

A refrigerant-filled chamber type refrigerator 80*d* of a two-stage expansion structure is provided so as to penetrate the heat-insulating container 130 such that a part of the refrigerator 80*d* is located inside the container 130 and the other part thereof is located outside the container 130. The refrigerator 80*d* maintains the temperature environment of the superconducting coil 137. Specifically, the refrigerator 80*d* cools the thermal shield 135 to about 50 K and cools the thermal shield 134 to about 5 K.

The refrigerant-filled chamber type refrigerator 80*d* comprises a cold head 81*d* and a gas pressure varying mechanism 139. The cold head 81*d*, like the cold head shown in FIG. 5, comprises a first-stage refrigerating unit 83 and a second-stage refrigerating unit 84 connected in series to the first-stage refrigerating unit 83. The first-stage refrigerating unit 83 adopts a Stirling refrigeration cycle in cooperation with the gas pressure varying mechanism 139 (described later), and the second-stage refrigerating unit 84 adopts a pulse tube refrigerating cycle.

In the refrigerant-filled chamber type refrigerator 80*d*, a first-stage cooling stage 87 provided on the first-stage refrigerating unit 83 cools the thermal shield 135 to about 50 K, and an endothermic unit 101 serving as second cooling stage cools the thermal shield 134 to about 5 K.

The refrigerant-filled chamber type refrigerator 80*d* built in the superconducting magnet apparatus of this embodiment differs from the refrigerant-filled chamber type refrigerator 80 built in the super-conducting magnet apparatus shown in FIG. 5 in that the first-stage refrigerating unit 83 cooperates with the gas pressure varying mechanism 139 to constitute the Stirling refrigerating cycle.

Specifically, the displacer 86 is coupled to a crank mechanism 142 provided within a crank chamber 141 via a coupling member 140 such as a coupling rod or a scotch yoke. The displacer 86 is reciprocally moved in synchronism with the rotation of the crank mechanism 142. The cylinder 85 is separated from the crank chamber 141 by means of a sealing device 143. The crank mechanism 142 is rotated by a motor (not shown).

On the other hand, the gas pressure varying mechanism 139 comprises a cylinder 144 and a piston 145 reciprocally movably housed in the cylinder 144. The piston 145 is coupled to the crank mechanism 142 via a coupling member 146 such as a coupling rod or a scotch yoke. The piston 145 is reciprocally moved with a predetermined phase error in relation to the reciprocal movement phase of the displacer 86. The cylinder 144 is separated from the crank chamber 141 by a sealing device 147. A volume-variable space 148 defined between the cylinder 144 and piston 145 communicates with a space 150 defined between the cylinder 85 and the rear face of the displacer 86 via a gas passage 149. Helium gas is sealed in a closed space formed by the space 148, gas passage 149, cylinder 85, refrigerant-filled chamber 98, pulse tube 102 and buffer tank 105.

The refrigerating principle of the Stirling refrigerating cycle is basically the same as that of the Gifford-McMahon (GM) refrigeration cycle. Specifically, when the crank mechanism 142 is rotated, two operations are repeated: one being such that helium gas is compressed in the space 148 defined by the cylinder 144 and piston 145 and fed out, and the other being such that the helium gas is sucked in the space 148. Accordingly, the gas pressure varying mechanism 139 performs the operations equivalent to those performed by the compressor 82, high-pressure valve 95 and low-pressure valve 96 shown in FIGS. 5 and 8.

In this superconducting magnet apparatus of immersion cooling system according to this embodiment, too, the second-stage refrigerating unit 84 adopting the pulse tube refrigerating cycle requiring no movable element, i.e. no sliding seal element is situated on the low-temperature side, the temperature condition for which is severest. Thus, the refrigeration power of the second cooling stage is prevented from deteriorating due to the presence of the sliding seal element, and the operation for maintaining the temperature environment can be stably performed for a long time. Therefore, the same advantage as with the apparatus shown in FIG. 5 can be obtained.

The present invention is not limited to the above-described embodiments. For example, the refrigerant-filled chamber type refrigerator 80 built in the superconducting magnet apparatus shown in FIG. 5 may be replaced with the refrigerant-filled chamber type refrigerator 80*d* shown in FIG. 13. In the embodiment shown in FIG. 12, the endothermic unit 101 may be located within the inner bath 111 and the helium gas in the inner bath 111 may be liquefied on the outer surface of the endothermic unit 101. In the embodiments shown in FIGS. 12 and 13, the driving motor may be covered with a magnetic shield to prevent the operation of the motor from becoming unstable due to the magnetic field generated by the superconducting coil. In addition, in the embodiments shown in FIGS. 5 and 13, a restrictor may be provided midway along the capillary tubes 103 and 104 in order to provide a predetermined phase difference between the gas pressure variation of the pulse tube refrigerator and the displacement of gas. Moreover, the pulse tube refrigerator may be formed in a multiple-stage construction. In the embodiments, the first-stage refrigerators adopt the Gifford-McMahon (GM) refrigeration cycle or Stirling refrigerating cycle. However, an improved Solvay refrigerating cycle may be used as an alternative refrigerating cycle wherein a refrigerant-filled chamber is of movable type.

As has been described above, according to the present embodiment, the static type refrigerant-filled chamber is used at least as a final-stage one of the refrigerant-filled chamber type refrigerator for maintaining the temperature environment of the superconducting coil. Thus, a stable refrigeration power of the final cooling stage can be exhibited for a long time period, contributing to the prevention of an increase in evaporation amount of cryogenic refrigerant and the prevention of quenching of the superconducting coil.

A description will now be given of a preferred embodiment of the present invention, wherein a phase control mechanism of a pulse tube refrigerator is situated in a normal-temperature region, whereby operability, easiness of maintenance and reliability are enhanced. Specifically, in a conventional refrigerant-filled chamber type refrigerator adopting a Gifford-McMahon (GM) refrigeration cycle, a sliding seal element is provided in a cryogenic part. Owing to leak at the sealing portion, the refrigeration power is considerably deteriorated and it is fundamentally difficult to maintain stable refrigeration power.

In this embodiment, a pulse tube refrigerator is used as a final-stage cooling unit of the cooling system. Since the pulse tube refrigerator includes no movable part, no sliding seal element is needed. Thus, deterioration of refrigeration power due to the presence of the sliding seal element can be prevented.

In addition, the high-temperature end portion of the pulse tube of the pulse tube refrigerator is located in the normal-temperature region. Thus, it is easy to provide a mechanism for performing a phase control necessary for the pulse tube refrigerator, i.e. a mechanism for providing a predetermined phase difference between the pressure variation phase and the gas displacement phase. More specifically, since the phase control mechanism of the pulse tube refrigerator is located in the normal-temperature region, the operability, easiness of maintenance and reliability are enhanced.

Specific embodiments will now be described with reference to the accompanying drawings.

Figure 14:
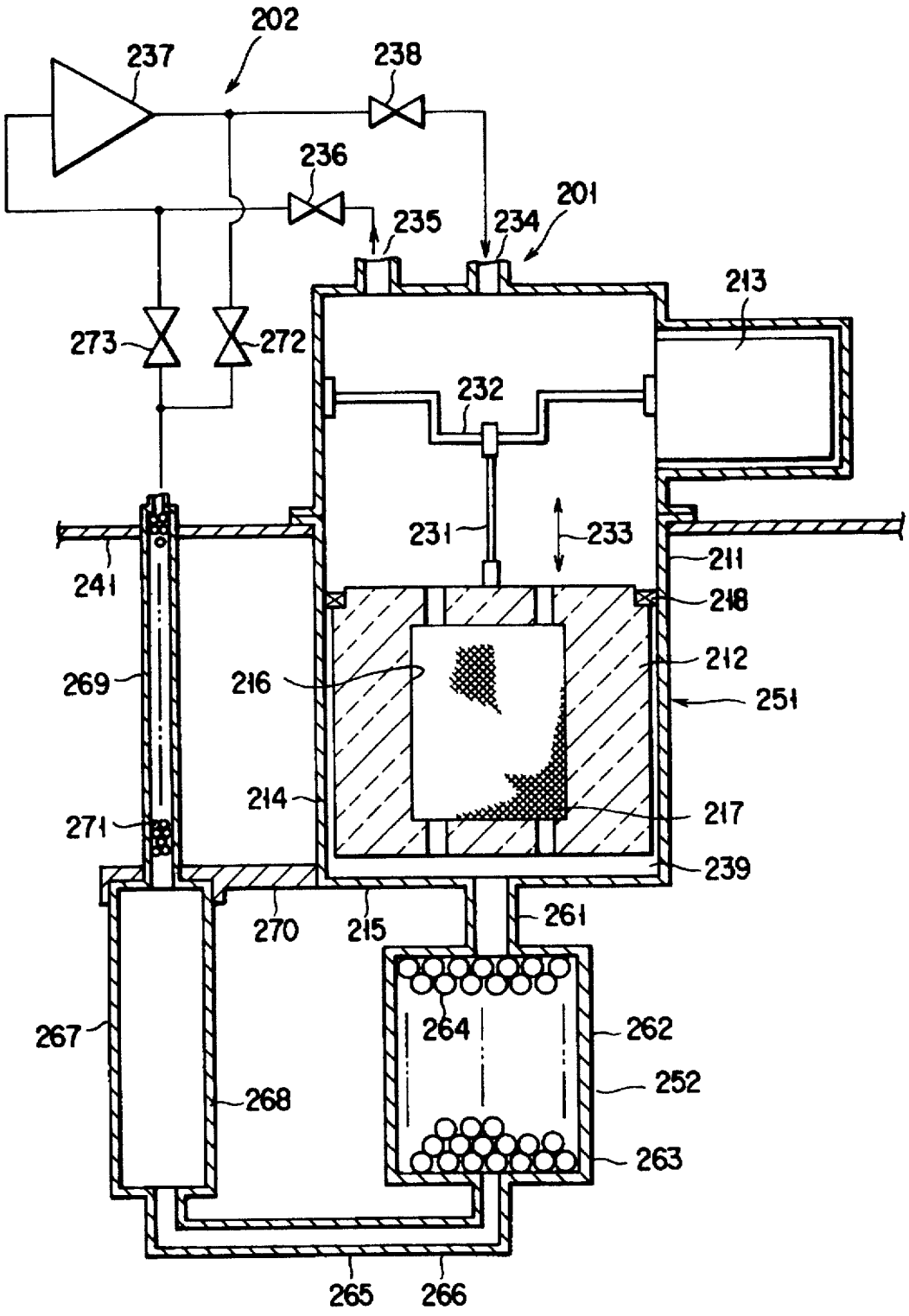
FIG. 14 schematically shows the structure of a refrigerant-filled chamber type refrigerator according to an embodiment of the present invention.

FIG. 14 schematically shows the structure of a refrigerant-filled chamber type refrigerator according to an embodiment of the present invention.

This refrigerant-filled chamber type refrigerator is of two-stage expansion type and comprises a cold head 201 and a gas control system 202. Although the gas control system 202 may be provided within the cold head 201, the gas control system 202 is shown outside the cold head 201 in FIG. 14 for the purpose of clearer description.

The cold head 201 comprises a first-stage refrigerating unit 251 and a second-stage refrigerating unit 252 connected in series to the first-stage refrigerating unit 251. The first-stage refrigerating unit 251 adopts a Gifford-McMahon (GM) refrigeration cycle, and the second-stage refrigerating unit 252 adopts a pulse tube refrigerating cycle.

The structure of the first-stage refrigerating unit 251 will now be described. In the cold head 201, a displacer 212 formed of a heat insulating material is reciprocally movably housed within a closed cylinder 211. In general, the cylinder 211 has a large-diameter cylinder 214 formed of a thin stainless steel plate, etc. A cooling stage 215 is provided in the cylinder 211. The displacer 212 reciprocally moves within the cylinder 214. An axially extending fluid passage 216 is formed within the displacer 212. A mesh-like coldness-accumulating material 217 formed of, e.g. copper is contained in the fluid passage 216. A sealing device 218 is provided between the outer peripheral surface of the displacer 212 and the inner peripheral surface of the cylinder 214.

An upper end portion of the displacer 212 is coupled to a rotary shaft of a motor 213 via a coupling rod 231, a scotch yoke or a crank shaft 232. If the motor 213 is rotated, the displacer 212 is reciprocally moved in synchronism with the rotation of the motor 213, as indicated by a solid-line double-headed arrow 233 in FIG. 14. An inlet 234 of helium gas and an outlet 235 of helium gas are formed in the upper side wall of the cylinder 214. The inlet 234 and outlet 235 are connected to the gas control system 202.

In the gas control system 202, the outlet 235 is connected to the inlet 234 via a low-pressure valve 236, a compressor 237 and a high-pressure valve 238. The low-pressure valve 236 and a high-pressure valve 238 are opened/closed in synchronism with the rotation of the motor 213 in a manner described below. The gas control system 202 constitutes a helium gas circulating system passing through the cylinder 211. Specifically, two operations are alternately performed: one operation being such that low-pressure (about 8 atm) helium gas is compressed by the compressor 237 and the pressurized helium gas (about 20 atm) is fed into the cylinder 211, the other being such that the helium gas is exhausted from the inside of the cylinder 211. In FIG. 14, numeral 14 denotes an outer wall of a heat insulating container on which the refrigerator is attached.

The structure of the second-stage cooling unit 252 will now be described.

Specifically, one end portion of a pipe 261 is connected to a head wall of the cylinder 214 so as to communicate with the inside of the cylinder 214. The other end portion of the pipe 261 is connected to one connection port of a second-stage refrigerant-filled chamber 262. The second-stage refrigerant-filled chamber 262 comprises a container 263 formed of a heat insulating material and a magnetic coldness-accumulating material 264 such as $Er_3Ni$ which makes use of, e.g. abnormal magnetic specific heat due to a magnetic phase transition. The magnetic coldness-accumulating material 264 is contained in the container 263. The other connection port of the second-stage refrigerant-filled chamber 262 is connected to one end portion of a pulse tube 267 via an endothermic pipe 266 constituting a second cooling stage 265.

The second cooling stage 265 is thermally connected to a superconducting coil (not shown) or an inner bath containing a superconducting coil and liquid helium, thereby to efficiently cool the superconducting coil or the inner bath.

The main components of the superconducting magnet apparatus of this embodiment are a superconducting coil and a refrigerator. The refrigerator comprises a plurality of cooling stages, and a valve mechanism for supplying a refrigerant to each cooling stage. The final cooling stage, the other cooling stage and the superconducting coil are situated in a specific positional relationship. The positional relationship is determined on the basis of characteristics (shape, strength, use, etc.) of the superconducting coil and characteristics (shape, capacity, use, etc.) of each cooling stage.

The pulse tube 267 comprises a pulse tube body 268 and a capillary tube 269. The pulse tube body 268 has a diameter greater than that of the endothermic pipe 266 and extends in parallel to the axis of the cylinder 214 up to a level substantially equal to the level of the first cooling stage 215. The capillary tube 269 has a diameter smaller than that of the pulse tube body 268 and has one end portion communicating with an upper end portion of the pulse tube body 268 and the other end portion hermetically penetrating an outer wall 241 of the heat-insulating container and extending to the normal-temperature region. A boundary portion between the pulse tube body 268 and capillary tube 269 is thermally connected to the first cooling stage 215 via a heat conductive member 270. A coldness-accumulating material 271 formed of, e.g. lead grains is contained in the capillary tube 269, thereby to prevent entrance of heat from the normal-temperature region into the pulse tube body 268.

On the other hand, in the gas control system 202, the outlet 235 is connected to the inlet 234 via the low-pressure valve 236, compressor 237 and high-pressure valve 238. A gas discharge end portion of the compressor 237 is connected via an auxiliary high-pressure valve 272 to an end portion of the capillary tube 269, which projects to the normal-temperature region. A gas suction end portion of the compressor 237 is connected via an auxiliary low-pressure valve 273 to the end portion of the capillary tube 269, which projects to the normal-temperature region. The low-pressure valve 236 and high-pressure valve 238 are synchronized with the rotation of the motor 213 and are opened/closed in relation to the volume (varying in a range of 0 to Vmax) of a first expansion chamber defined in the cylinder 214 in a manner illustrated in FIG. 15. The auxiliary high-pressure valve 272 and auxiliary low-pressure valve 273 serve to set a predetermined phase difference between the phase of pressure variation in the pulse tube refrigerator, which constitutes the second cooling stage 252, and the phase of displacement of gas. The auxiliary high-pressure valve 272 and auxiliary low-pressure valve 273 are similarly opened/closed in synchronism with the rotation of the motor 213 in the manner illustrated in FIG. 15.

The operation of the refrigerant-filled chamber type refrigerator having the above structure will now be described.

Coldness is generated at the first cooling stage 215 of the first-stage refrigerating unit 251 by the GM refrigerating cycle.

On the other hand, coldness is generated at the second cooling stage 265 of the second-stage refrigerating unit 252 by the pulse tube refrigerating cycle including the pulse tube 267 as expansion device. Specifically, coldness is generated at a low-temperature end portion of the pulse tube 267, i.e. a boundary portion between the pulse tube 267 and the endothermic pipe 266, by pressure waves of high/low pressure created within the cold head 201 by the opening/closing of the low-pressure valve 236 and high-pressure valve 238.

Figure 15:
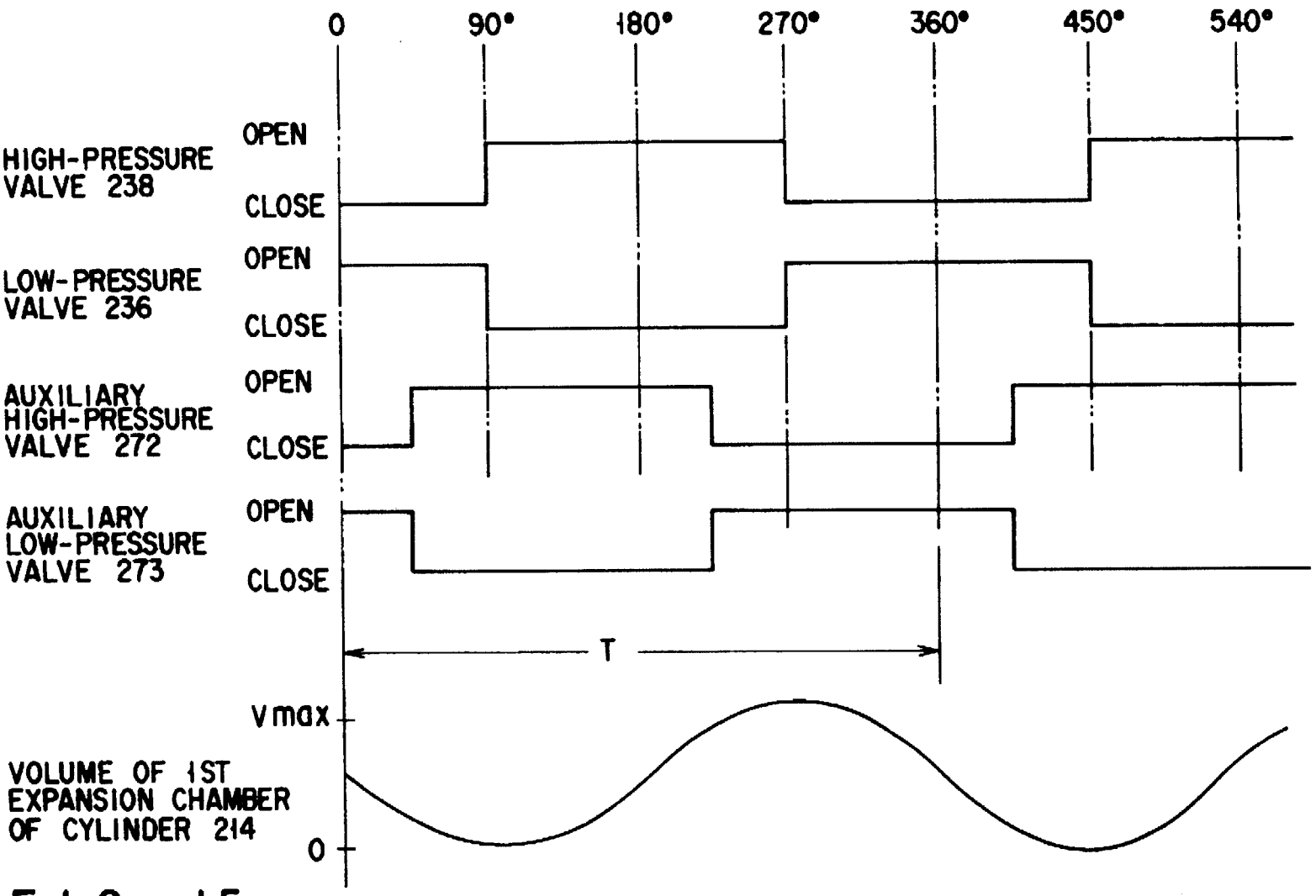
FIG. 15 shows the opening/closing timing of phase control valves built in the refrigerator shown in FIG. 14.

In this embodiment, the auxiliary high-pressure valve 272 and auxiliary low-pressure valve 273 for supplying high-pressure helium gas to the portion of the capillary tube 269 projecting to the normal-temperature region and for exhausting the helium gas therefrom are provided in order to increase the coldness generation amount in the second cooling stage 265 by providing a predetermined phase difference between the phase of pressure variation in the pulse tube 267 and the phase of displacement of gas. The auxiliary high-pressure valve 272 and auxiliary low-pressure valve 273 are opened/closed in synchronism with the reciprocal movement of the displacer 212. Specifically, as shown in FIG. 15, the auxiliary high-pressure valve 272 is opened/closed at a timing earlier than the high-pressure valve 238, and the auxiliary low-pressure valve 273 is opened/closed at a timing earlier than the low-pressure valve 236. By this control, the coldness generation amount at the second cooling stage 265 can be increased.

In this embodiment, a coldness-accumulating material 271 is contained in the capillary tube 269, thereby to prevent normal-temperature helium gas from entering the body of the pulse tube 268 via the auxiliary high-pressure valve 272. Thus, the coldness-accumulating material 271 prevents the entrance of heat from the normal-temperature region and allows a helium gas at a temperature substantially equal to the temperature of the first cooling stage 215 to flow into the high-temperature end portion of the body of the pulse tube 268.

In the refrigerant-filled chamber type refrigerator of this embodiment, a pulse tube refrigerator is used as second-stage (final-stage) refrigerating unit 252 of the cooling system. Since the pulse tube refrigerator includes no movable part, no sliding seal element is needed. Thus, deterioration of refrigeration power due to the presence of the sliding seal element can be prevented.

In addition, the high-temperature end portion of the pulse tube 267 of the pulse tube refrigerator is substantially located in the normal-temperature region. Thus, it is easy to provide a mechanism for performing a phase control necessary for the pulse tube refrigerator. Therefore, the coldness generation amount of the pulse tube 267 is increased and the refrigeration power is remarkably enhanced. More specifically, since the phase control mechanism is located in the normal-temperature region, the operability, reliability and easiness of maintenance of valves, etc. are enhanced.

In the above-described embodiment, the temperature of the boundary portion between the pulse tube body 268 and capillary tube 269 is set to be substantially equal to the temperature of the first cooling stage 215 by using the heat conductive member 270. However, the heat conductive member 270 may be dispensed with. In addition, although the pulse tube 267 comprises the large-diameter pulse tube body 268 and capillary tube 269, the pulse tube body may have a uniform diameter. Besides, instead of containing the coldness-accumulating material, the high-temperature end portion of the pulse tube may be projected to the normal-temperature region and connected to the auxiliary high-pressure valve and auxiliary low-pressure valve.

Figure 16:
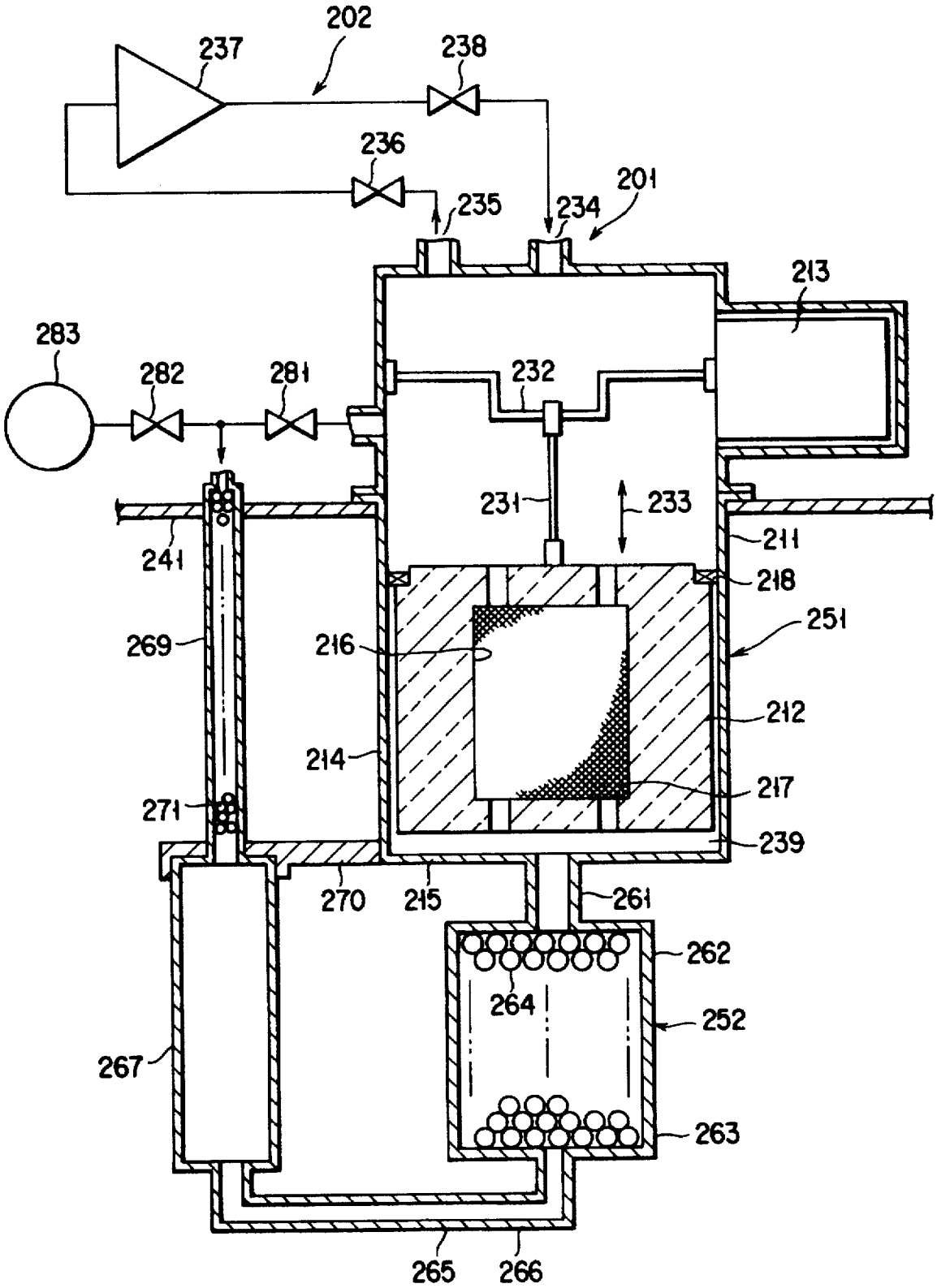
FIG. 16 schematically shows the structure of a refrigerant-filled chamber type refrigerator according to another embodiment of the present invention.

FIG. 16 schematically shows the structure of a refrigerant-filled chamber type refrigerator according to another embodiment of the present invention. In FIG. 16, the functional parts common to those in FIG. 14 are denoted by like reference numerals, and so a detailed description thereof is omitted.

The refrigerant-filled chamber type refrigerator according to this embodiment differs from the embodiment shown in FIG. 14 with respect to the structure of the phase control mechanism of the pulse tube refrigerator constituting the second-stage refrigerating unit 252. Specifically, the portion of the capillary tube 269, which projects to the normal-temperature region, is made to communicate with the gas introducing/exhausting portion of the first-stage refrigerating unit 251, i.e. the upper space of the cylinder 214, via a flow rate control valve 281, and also made to communicate with a buffer tank 283 provided in the normal-temperature region via an orifice valve 282.

With this structure, the second-stage refrigerating unit 252 functions as double-inlet type pulse tube refrigerator, and can increase the generation amount of coldness. Thus, the same advantage as with the embodiment shown in FIG. 14 can be obtained.

In this embodiment, the flow rate control valve 281 and orifice valve 282 may be replaced with flow rate restriction elements such as capillary tubes having the same fluid resistance as these valves 281 and 282. In this embodiment, too, the heat conductive member 270 may be omitted. Although the pulse tube 267 is composed of the large-diameter pulse tube body 268 and capillary tube 269, the pulse tube may be formed to have a uniform diameter. Besides, instead of containing the coldness-accumulating material, the high-temperature end portion of the pulse tube may be projected to the normal-temperature region and made to communicate with the upper space of the cylinder 214 and/or buffer tank 283.

In the embodiments shown in FIGS. 14 and 16, the coldness-accumulating material such as magnetic coldness-accumulating material 264 in the container 263. Instead, a container containing coldness-accumulating material may be put within the container 263 and a seal member may be provided between both containers. In this case, since the seal member is static, the amount of leak is small and the refrigeration power is not affected.

In addition, in the above embodiments, the first-stage refrigerating unit 251 adopts the Gifford-McMahon (GM) refrigeration cycle. However, the refrigerating unit, other than the final-stage one, may adopt the Stirling refrigerating cycle or improved Solvay refrigerating cycle. In the above embodiments, the refrigerating system comprises two-stage refrigerating units. However, the refrigerating system may comprise three or more stages of units.

As has been described above, in the present invention, the pulse tube refrigerator requiring no movable element, i.e. no sliding seal element is used in the final-stage refrigerating unit. Thus, the refrigeration power is prevented from deteriorating due to the presence of the sliding seal element. In addition, since the high-temperature end portion of the pulse tube in the pulse tube refrigerator is substantially located in the normal-temperature region, it is easy to provide a mechanism for performing a phase control necessary for the pulse tube refrigerator. Thus, a desirable phase difference can be provided and the refrigeration power is further enhanced.

A description will now be given of a refrigerant-filled chamber type refrigerator according to a preferred embodiment of the invention, wherein the applicability to objects to be cooled is enhanced and the refrigeration power of the final-stage refrigerating unit is enhanced. At first, the background of this embodiment will be described. In the conventional refrigerant-filled chamber type refrigerator adopting the Gifford-McMahon (GM) refrigeration cycle, a displacer is provided in each of the refrigerating units from the first-stage one to the final-stage one. Each displacer holds coldness-accumulating material in each stage and constitutes a part of the expansion chamber.

In this conventional refrigerant-filled chamber type refrigerator, however, it is necessary that the displacer is mechanically coupled to the associated refrigerating unit and the respective refrigerating units are coaxially arranged. If the number of stages is increased, the total length of the refrigerator increases. As a result, the structure of the object to be cooled is limited. Furthermore, a sliding seal element needs to be provided in the final-stage refrigerating unit, and it is difficult to reduce gas leak from the seal portion. It is thus difficult to enhance the refrigeration power of the final-stage refrigerating unit.

This embodiment provides a refrigerant-filled chamber type refrigerator wherein the applicability to objects to be cooled is enhanced and the refrigeration power of the final-stage refrigerating unit is enhanced.

In this embodiment, a pulse tube refrigerator is used as final-stage refrigerating unit. The axis of the pulse tube of the pulse tube refrigerator is parallel to that of the refrigerant-filled chamber. The crossing angle between the axis of the final-stage refrigerating unit and the axis of the refrigerating unit other than the final-stage one is set at, e.g. 90° or 180°. Thereby, the total length of the refrigerator can be greatly reduced, as compared with the conventional one, and the applicability to various objects to be cooled is enhanced. The crossing angle is also defined as a difference of angle between the axis of the final-stage refrigerating unit and the axis of the refrigerating unit other than the final-stage one.

In the case of pulse tube refrigerator, if the low-temperature portion of the pulse tube is located upward in the direction of gravity and the high-temperature portion of the pulse tube is located downward in the direction of gravity, a low-temperature gas with high density is located upward. As a result, convection occurs in the pulse tube and the refrigeration power is deteriorated. Thus, in order to enhance the refrigeration power of the pulse tube refrigerator, it is necessary to situate the low-temperature portion of the pulse tube downward in the direction of gravity and the high-temperature portion of the pulse tube upward in the direction of gravity. On the other hand, convection tends to occur less easily in the refrigerating unit having the GM refrigerating cycle, Stirling refrigerating cycle or improved Solvay refrigerating cycle, than in the pulse tube refrigerator unit. Therefore, it is less possible that the refrigeration power of the former unit varies due to the condition for arrangement. Accordingly, if the condition for arrangement of the pulse tube refrigerator is satisfied, the advantage obtained with the feature that the total length of the refrigerator is short can be fully exhibited.

Since the pulse tube refrigerator includes no movable part, there is no need to provide a sliding seal element. Therefore, the final-stage refrigerating unit can exhibit high refrigeration power.

Figure 17:
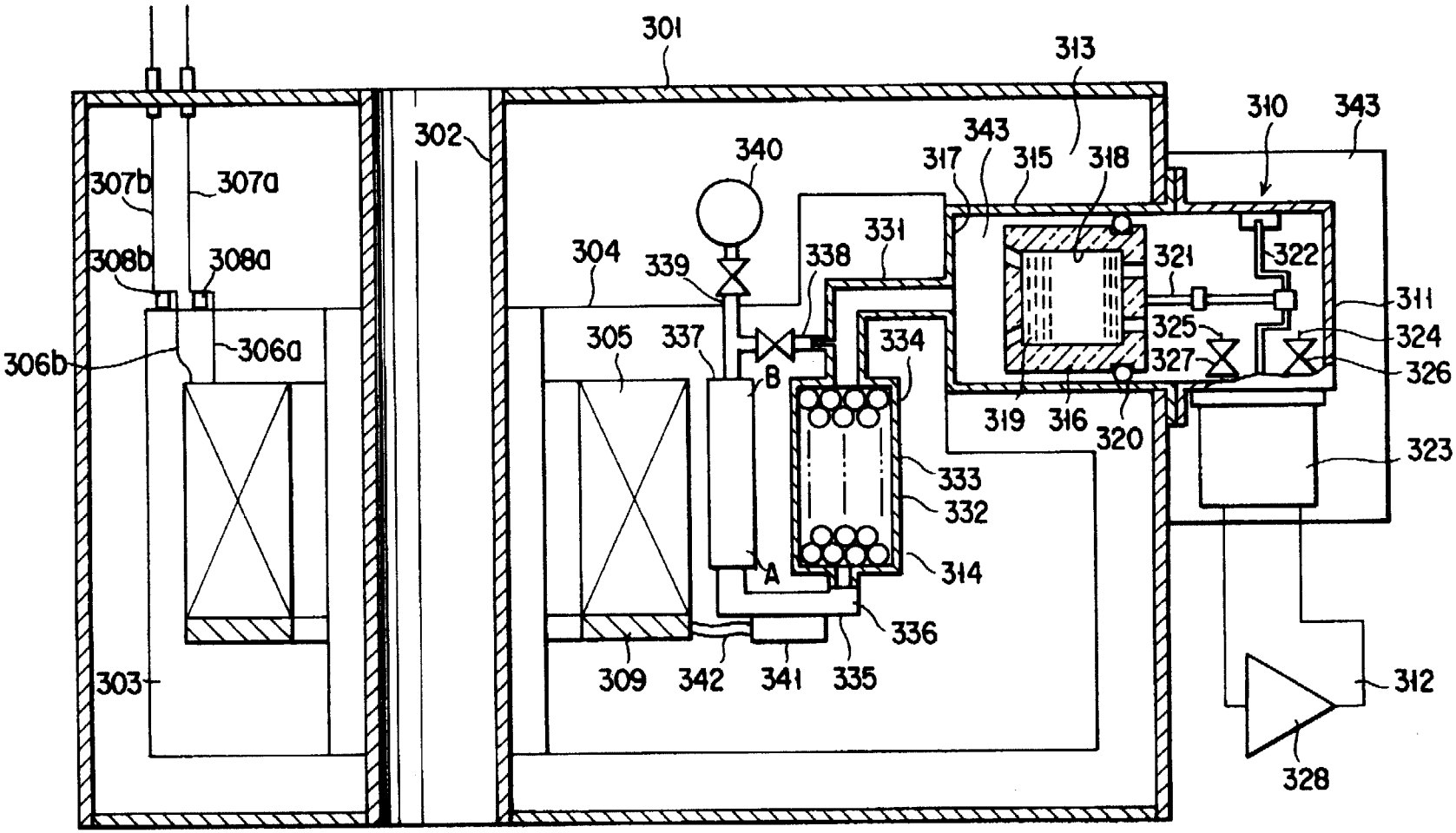
FIG. 17 schematically shows the structure of a superconducting magnet apparatus of a refrigerator direct cooling system, in which a refrigerant-filled chamber type refrigerator according to an embodiment of the invention is built.

A preferred embodiment of the invention will now be described in detail with reference to the accompanying drawings. FIG. 17 shows a superconducting magnet apparatus of a refrigerator direct cooling system according to the embodiment of the present invention.

As is shown in FIG. 17, a vacuum container 301 formed of a non-magnetic material is integrally provided with a cylindrical wall 302 which hermetically penetrates upper and lower walls of the container 301. A thermal shield 304 formed of a non-magnetic metallic material is disposed within the vacuum container 301 so as to define an annular space 303 surrounding the cylindrical 302.

A superconducting coil 305 is disposed within the annular space 303 defined by the thermal shield 304 so as to be coaxial with the cylindrical wall 302. The superconducting coil 305 is formed of a superconducting wire having a critical temperature of, e.g. about 15 K. Both end portions of the superconducting wire are connected to first end portions of current leads **306*a* and 306*b* formed of, e.g. an oxide superconducting material having a critical temperature of 50 K or above. Second end portions of the current leads 306*a* and 306*b* are led out of the thermal shield 304 in a insulated state from the thermal shield 304 and are connected to first end portions of current leads 307*a* and 307*b* formed of, e.g. deoxidized phosphor copper. Connection portions between the current leads 306*a* and 306*b* and the current leads 307*a* and 307*b* are thermally connected to thermal anchors 308*a* and 308*b* of, e.g. aluminum nitride attached to the outer surface of the thermal shield 304. Second end portions of the current leads 307*a* and 307*b* are led to the outside via bushings penetrating the upper wall of the vacuum container 301. A heat conductive member 309 of copper is disposed on the superconducting coil 305, for example, such that the heat conductive member 309 is put in close contact with one axial end face of the coil 305**.

A refrigerant-filled chamber type refrigerator 310 of a two-stage expansion structure is provided so as to penetrate the vacuum container 301 such that a part of the refrigerator 310 is located inside the container 301 and the other part thereof is located outside the container 301. The refrigerator 310 maintains the temperature environment of the superconducting coil 305. Specifically, the refrigerator 310 cools the thermal shield 304 to about 50 K and cools the superconducting coil 305 to about 5 K.

The refrigerant-filled chamber type refrigerator 310 comprises a cold head 311 and a gas control system 312. The cold head 311 comprises a first-stage refrigerating unit 313 and a second-stage refrigerant unit 314 connected in series to the first-stage refrigerating unit 313. The first-stage refrigerating unit 313 adopts the same Gifford-McMahon (GM) refrigeration cycle. The second-stage refrigerating unit 314 adopts a pulse tube refrigerating cycle.

The first-stage refrigerating unit 313 has a closed cylinder 315 having an axis perpendicular to the direction of gravity. A displacer 316 formed of a heat insulating material is housed within the cylinder 315 so as to be reciprocally movable in a direction perpendicular to the direction of gravity. The first-stage refrigerating unit 313 is provided with a first cooling stage 317 for generating coldness by expanding a compressed refrigerant gas at a head wall portion of the cylinder 315. The first cooling stage 317, more specifically, the outer surface of the head wall of the cylinder 315, is thermally connected to the thermal shield 304. The cylinder 315 is formed of a thin stainless steel plate, etc.

An axially extending fluid passage 318 for constituting a first-stage refrigerant-filled chamber is formed within the displacer 316. A coldness-accumulating material 319 of a mesh structure of, e.g. copper is contained within the fluid passage 318.

A sealing device 320 is provided between an upper portion of the outer peripheral surface of the displacer 316, i.e. a portion with a temperature near normal temperature, and the inner peripheral surface of the cylinder 315.

A right-hand end portion (in FIG. 17) of the displacer 316 is coupled to a rotary shaft of a motor 323 via a coupling rod 321, a scotch yoke or a crank shaft 322. If the motor 323 is rotated, the displacer 316 is reciprocally moved in synchronism with the rotation of the motor 323 in the horizontal direction in FIG. 17. An inlet 324 for introducing helium gas and an outlet 325 for exhausting the helium gas are provided in the right-hand space of the cylinder 315. The inlet 324 and outlet 325 are connected to the gas control system 312.

In the gas control system 312, the inlet 324 and outlet 325 are connected to the compressor 328 via a high-pressure valve 326 and a low-pressure valve 327 which are opened/closed in synchronism with the rotation of the motor 323. The compressor 328, high-pressure valve 326 and low-pressure valve 327 of the gas control system 312 constitute a helium gas circulating system passing through the cylinder 315. Specifically, two operations are alternately performed: one operation being such that low-pressure (about 8 atm) helium gas is compressed by the compressor 328 and the pressurized helium gas (about 20 atm) is fed into the cylinder 315, the other being such that the helium gas is exhausted from the inside of the cylinder 315.

The second-stage refrigerating unit 314 is situated within the space defined by the thermal shield 304 and has the following structure. One end portion of a pipe 331 is connected to the head wall of the cylinder 315 so as to communicate with the inside of the cylinder 315. The other end portion of the pipe 331 is connected to one connection port of a second-stage refrigerant-filled chamber 332. The second-stage refrigerant-filled chamber 332 comprises a container 333 formed of a heat insulating material and a magnetic coldness-accumulating material 334 such as $Er_3Ni$, which is contained in the container 333 and makes use of, e.g. abnormal magnetic specific heat due to a magnetic phase transition.

The other connection port of the second-stage refrigerant-filled chamber 332 is connected via an endothermic pipe 336, which constitutes a second cooling stage 335, to one end portion of a pulse tube 337 having a greater diameter than the endothermic pipe 336. The other end portion of the pulse tube 337 communicates with the pipe 331 via a capillary tube 338 having an orifice valve and communicates via a capillary tube 339 having an orifice valve with a buffer tank 340 provided between the thermal shield 304 and the upper wall of vacuum container 301. Specifically, the second-stage refrigerating unit 314 constitutes a pulse tube refrigerator adopting a double-inlet system. Although not shown, a higher-temperature side of the pulse tube 337 and the buffer tank 340 are thermally connected to the thermal shield 304 and cooled.

The refrigerant-filled chamber 332 and pulse tube 337 are situated in the following positional relationship. A low-temperature end portion A of the pulse tube 337 is situated downward in the direction of gravity, and a high-temperature end portion B of the pulse tube 337 is situated upward in the direction of gravity. The axis of the pulse tube 337 is substantially parallel to that of the refrigerant-filled chamber 332, and the inclination angle θ of these axes to the direction of gravity is $\theta<\pm30°$. In this embodiment, the crossing angle between the axis of the pulse tube 337, on the one hand, and the axes of the refrigerant-filled chamber 332 and the cylinder, on the other, is set at about 90°.

The second cooling stage 335 is thermally connected to a heat conductive block 341 formed of, e.g. a copper block. The heat conductive block 341 and the heat conductive member 309 are thermally coupled by a heat conductive material 342 of copper, etc.

In FIG. 17, numeral 343 denotes a magnetic shield 108 prevents a magnetic field generated by the superconducting coil 305 from adversely affecting the operation of the motor 323. FIG. 17 does not show position holding means for the superconducting coil 305 and thermal shield 304.

The operation of the superconducting magnet apparatus with the above structure in the driving mode, in particular, the operation for maintaining the temperature environment of the superconducting coil 305, will now be described.

Coldness necessary for maintaining the temperature environment of the superconducting coil 305 is generated by the first cooling stage 317 and the second cooling stage 335. The first cooling stage 317 is cooled down to about 30 K in an ideal condition with no thermal load. The second cooling stage 335 is cooled down to about 4 K. Accordingly, a temperature gradient between normal temperature (300 K) and 30 K is provided between the right and left ends of the displacer 316, and a temperature gradient between 30 K and 4 K is provided between the upper and lower ends of the refrigerant-filled chamber 332 (i.e. the upper and lower ends of the pulse tube 337).

When the motor 323 starts to rotate, the displacer 316 reciprocally moves between the bottom dead point (the rightmost point in FIG. 17) and the top dead point (the leftmost point in FIG. 17). When the displacer 316 has reached the top dead point, the high-pressure valve 326 opens and the high-pressure helium gas enters the cold head 311. The sealing device 320 is provided between the outer peripheral surface of the displacer 316 and the inner peripheral surface of the cylinder 315. Accordingly, the incoming high-pressure helium gas flows through the fluid passage 318 defined in the displacer 316 to the pulse tube 337 via the refrigerant-filled chamber 332. While the high-pressure helium gas flows to the pulse tube 337, it is cooled by the coldness-accumulating material 319 to about 50 K and then cooled by the magnetic coldness-accumulating material 334 to about 5 K.

When the displacer 316 has reached the bottom dead point, the high-pressure valve 326 is closed and the low-pressure valve 327 is opened. If the low-pressure valve 327 is opened, the high-pressure helium gas in a space 343 between the displacer 316 and the head wall of the cylinder 315 adiabatically expands and generates coldness. By the generated coldness, the first cooling stage 317 absorbs external heat from the thermal shield 304. As a result, the thermal shield 304 is cooled down to about 50 K.

On the other hand, if the low-pressure valve 327 is opened, the high-pressure helium gas in the pulse tube 337 adiabatically expands and generates coldness. By the generated coldness, the second cooling stage 335 absorbs external heat from the superconducting coil 305 via the heat conductive block 341, heat conductive material 342 and heat conductive member 309. As a result, the superconducting coil 305 is cooled down to about 5 K which is lower than the critical temperature.

As the displacer 316 begins to move toward the top dead point once again, the low-temperature helium gas in the pulse tube 337 flows reversely into the second-stage refrigerant-filled chamber 332. The reverse flow of the low-temperature helium gas cools the magnetic coldness-accumulating material 334. The low-temperature helium gas in the space 343 passes through the fluid passage 318 while cooling the coldness-accumulating material 319. Accordingly, the helium gas heated approximately up to the normal temperature moves to the right-hand space of the cylinder 315, and this gas is exhausted to the compressor 328 via the low-pressure valve 327. The capillary tubes 338 and 339 and buffer tank 340 contribute to efficient coldness generation by adjusting the relationship in phase between the pressure variation and displacement of gas in the pulse tube refrigerator constituting the second-stage refrigerating unit 314.

The above-described cycle is repeated to maintain the temperature environment of the superconducting coil 305. Thus, the superconducting coil 305 is kept at about 5 K which is lower than the critical temperature, and the thermal shield 304 is kept at about 50 K at which heat due to radiation is prevented from entering the superconducting coil 305.

As has been described above, in the refrigerant-filled chamber type refrigerator according to the present embodiment, the second-stage refrigerating unit (final-stage refrigerating unit) 314 constitutes the pulse tube refrigerator. In the pulse tube 337 of the pulse tube refrigerator, the low-temperature end portion A is situated downward in the direction of gravity, and the high-temperature end portion B is situated upward in the direction of gravity. The axis of the pulse tube 337 is substantially parallel to that of the refrigerant-filled chamber 332, and the crossing angle between these axes, on the one hand, and the axis of the first-stage refrigerating unit (the unit other than the final-stage refrigerating unit) is set at about 90°. Thus, the total length of the refrigerator can be greatly reduced, as compared with the conventional one, and the applicability to various objects to be cooled is enhanced.

The characteristics of the pulse tube refrigerator will now be described. In the case of the pulse tube refrigerator, if the low-temperature end portion A of the pulse tube 337 is located upward in the direction of gravity and the high-temperature end portion of the pulse tube 337 is located downward in the direction of gravity, a low-temperature gas with high density is located upward. As a result, convection occurs in the pulse tube 337 and the refrigeration power is deteriorated.

Figure 18:
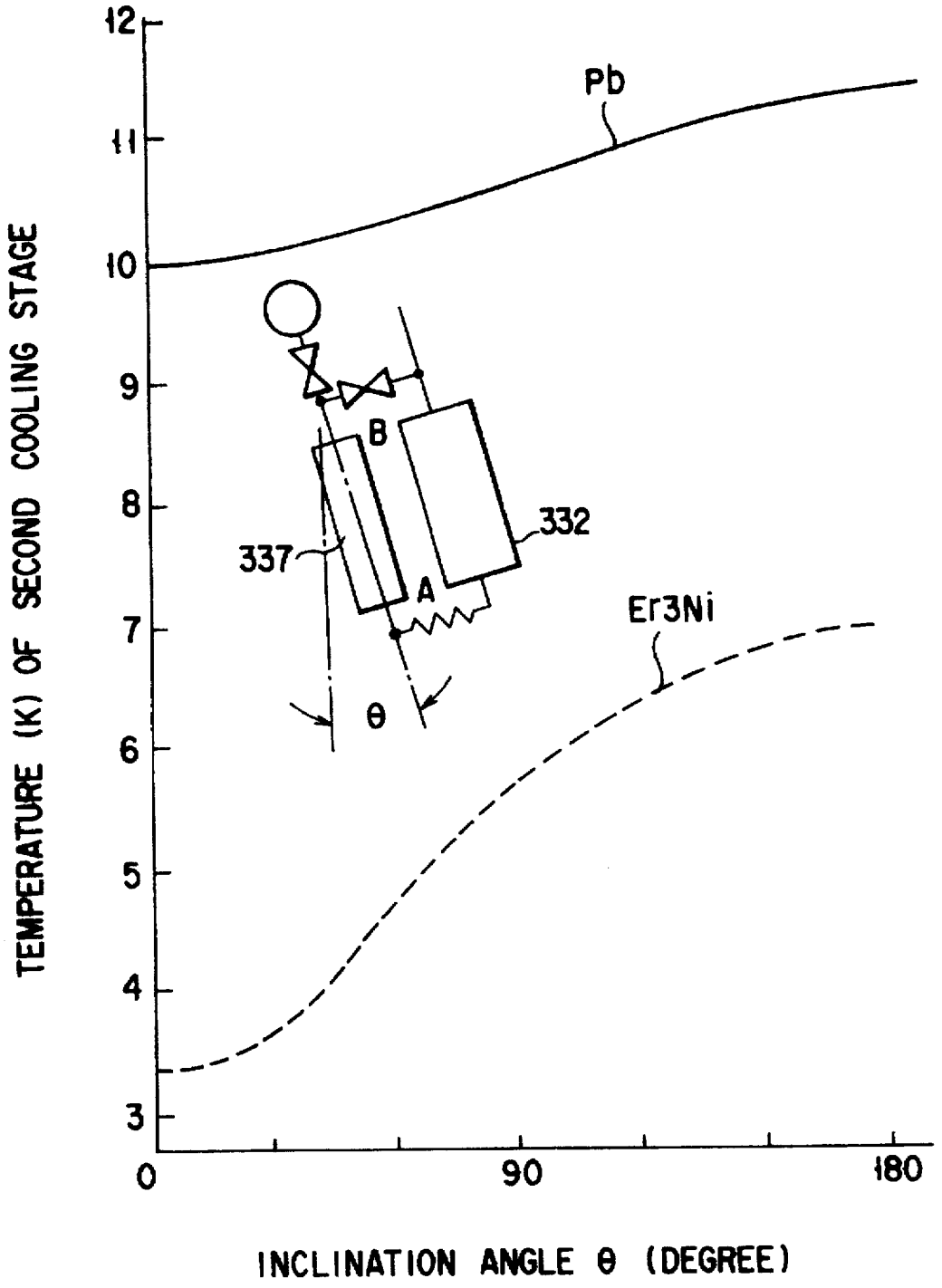
FIG. 18 is a graph showing an experimental result as to how the refrigeration power of a cooling stage is influenced by an inclination angle θ of the axes of a pulse tube and a refrigerant-filled chamber with respect to the direction of gravity.

FIG. 18 shows experimental results as to how the inclination angle θ of the axes of the pulse tube 337 and refrigerant-filled chamber 332 to the direction of gravity adversely affects the refrigeration power of the second cooling stage 335 at 4 K. In the experiments, the coldness-accumulating material in the refrigerant-filled chamber 332 was used as parameter. In FIG. 18, the angle θ=0° represents the state in which the axes of the pulse tube 337 and refrigerant-filled chamber 332 are parallel to the direction of gravity, the low-temperature end portion A of the pulse tube 337 is located downward in the direction of gravity and the high-temperature end portion of the pulse tube 337 is located upward in the direction of gravity. The angle θ=90° represents the state in which the axes of the pulse tube 337 and refrigerant-filled chamber 332 are perpendicular to the direction of gravity. The angle θ=180° represents the state in which the axes of the pulse tube 337 and refrigerant-filled chamber 332 are parallel to the direction of gravity, the low-temperature end portion A of the pulse tube 337 is located upward in the direction of gravity and the high-temperature end portion of the pulse tube 337 is located downward in the direction of gravity.

As seen from FIG. 18, the refrigeration power at 4 K depends on the inclination angle θ. As the angle θ increases, the refrigeration power becomes lower. In particular, the influence of the inclination angle θ is greater when a magnetic coldness-accumulating material represented by $Er_3Ni$ is used as coldness-accumulating material in the refrigerant-filled chamber 332, than when lead is used as coldness-accumulating material. Furthermore, the influence becomes conspicuous at θ=30° as critical value. Inversely speaking, if the angle is θ<30° , the refrigeration power is hardly deteriorated. Accordingly, when the pulse tube refrigerator is used, the condition of θ<30° needs to be met. On the other hand, convection tends to occur less easily in the first-stage refrigerating unit 313 having the GM refrigerating cycle. Therefore, it is less possible that the refrigeration power of this refrigeration unit varies due to the condition for arrangement. Accordingly, if the condition for arrangement of the pulse tube refrigerator is satisfied, the advantage obtained with the feature that the total length of the refrigerator is short can be fully exhibited. Besides, since the pulse tube refrigerator includes no movable part, there is no need to provide a sliding seal element. Therefore, the final-stage refrigerating unit can exhibit high refrigeration power.

Figure 19:
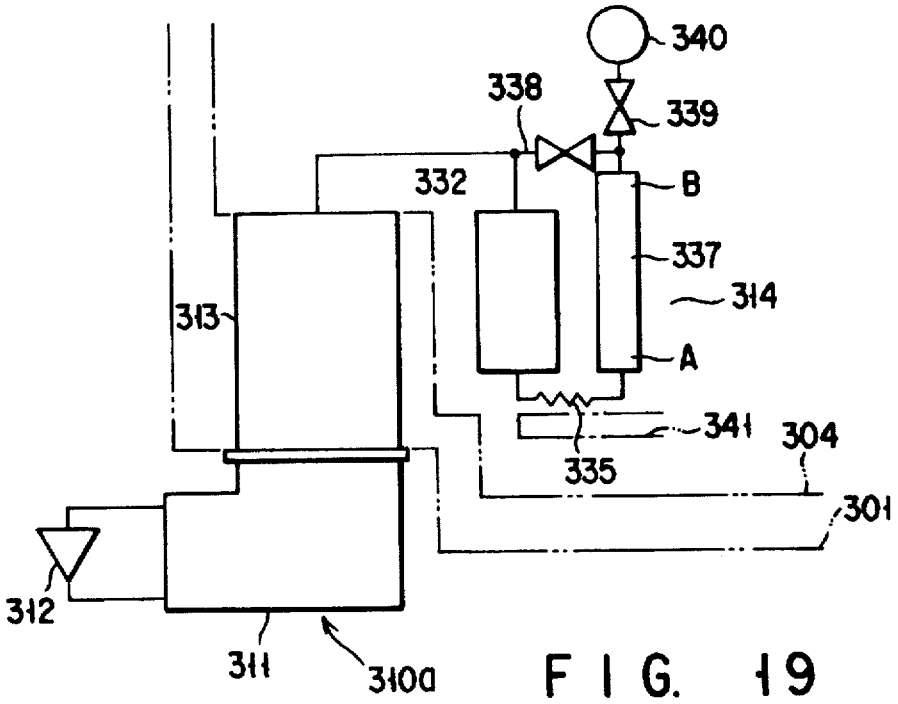
FIG. 19 schematically shows the structure of a refrigerant-filled chamber type refrigerator according to another embodiment of the present invention.

FIG. 19 schematically shows the structure of a refrigerant-filled chamber type refrigerator **310*a* according to another embodiment of the invention. In FIG. 19, the functional parts common to those in FIG. 17** are denoted by like reference numerals, and thus a detailed description thereof is omitted.

In the refrigerant-filled chamber type refrigerator **310*a* according to this embodiment, the axis of the pulse tube 337 is substantially parallel to that of refrigerant-filled chamber 332, and the inclination angle θ of these axes to the direction of gravity is set at θ<±30°. In addition, the crossing angle between the axes of the pulse tube 337 and refrigerant-filled chamber 332 and the axis of the first-stage refrigerating unit 313** is set at about 180°.

With this structure, too, the same advantage as with the embodiment of FIG. 18 can be obtained.

Figure 20:
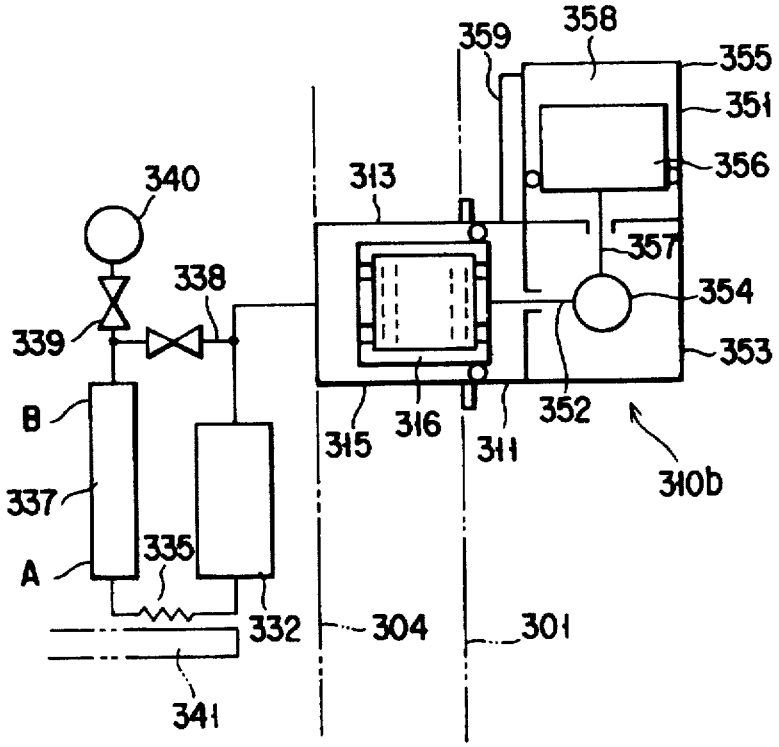
FIG. 20 schematically shows the structure of a refrigerant-filled chamber type refrigerator according to still another embodiment of the present invention.

FIG. 20 schematically shows the structure of a refrigerant-filled chamber type refrigerator **310*b* according to another embodiment of the invention. In FIG. 20, the functional parts common to those in FIG. 17** are denoted by like reference numerals, and thus a detailed description thereof is omitted.

The refrigerant-filled chamber type refrigerator **310*b* according to this embodiment differs from the refrigerator shown in FIG. 17 in that the first-stage refrigerating unit 313 and a gas pressure varying mechanism 351** constitute a Stirling refrigerating cycle.

Specifically, the displacer 316 of the first-stage refrigerating unit 313 is coupled to a crank mechanism 354 provided within a crank chamber 353 via a coupling member 352 such as a coupling rod or a scotch yoke. The displacer 316 is reciprocally moved in synchronism with the rotation of the crank mechanism 354. The cylinder 315 and the crank chamber 353 are separated by a sealing device. The crank mechanism 354 is rotated by a motor (not shown).

On the other hand, the gas pressure varying mechanism 351 includes a cylinder 355 and a piston 356 situated reciprocally movably within the cylinder 355. The piston 356 is coupled to a crank mechanism 354 via a coupling member 357 such as a coupling rod or a scotch yoke. The reciprocal movement of the piston 356 is controlled with a predetermined phase difference with respect to the phase of reciprocal movement of the displacer 316. The cylinder 355 and crank chamber 353 are separated by a sealing device. A volume variable space 358 defined between the cylinder 355 and piston 356 communicates via a gas passage 359 with a space defined between the cylinder 315 and the rear face of the displacer 316. Helium gas is sealed in a closed space defined by the space 358, gas passage 359, cylinder 315, refrigerant-filled chamber 332, pulse tube 337 and buffer tank 340.

In the refrigerant-filled chamber type refrigerator **310*b* according to this embodiment, too, the axis of the pulse tube 337 is substantially parallel to that of refrigerant-filled chamber 332, and the inclination angle θ of these axes to the direction of gravity is set at $\theta<\pm30°$. In addition, the crossing angle between the axes of the pulse tube 337 and refrigerant-filled chamber 332 and the axis of the first-stage refrigerating unit 313** is set at about 90°.

The refrigerating principle of the Stirling refrigerating cycle is basically the same as that of the Gifford-McMahon (GM) refrigeration cycle. Specifically, when the crank mechanism 354 is rotated, two operations are repeated: one being such that helium gas is compressed in the space 358 defined by the cylinder 355 and piston 356 and fed out, and the other being such that the helium gas is sucked in the space 358. Accordingly, the gas pressure varying mechanism 351 performs the operations equivalent to those performed by the gas control system 312 comprising the compressor 328, high-pressure valve 326 and low-pressure valve 327 shown in FIGS. FIG. 18.

With the above structure, too, the same advantage as with the embodiment shown in FIGS. 17 and 18 can be obtained.

Figure 21:
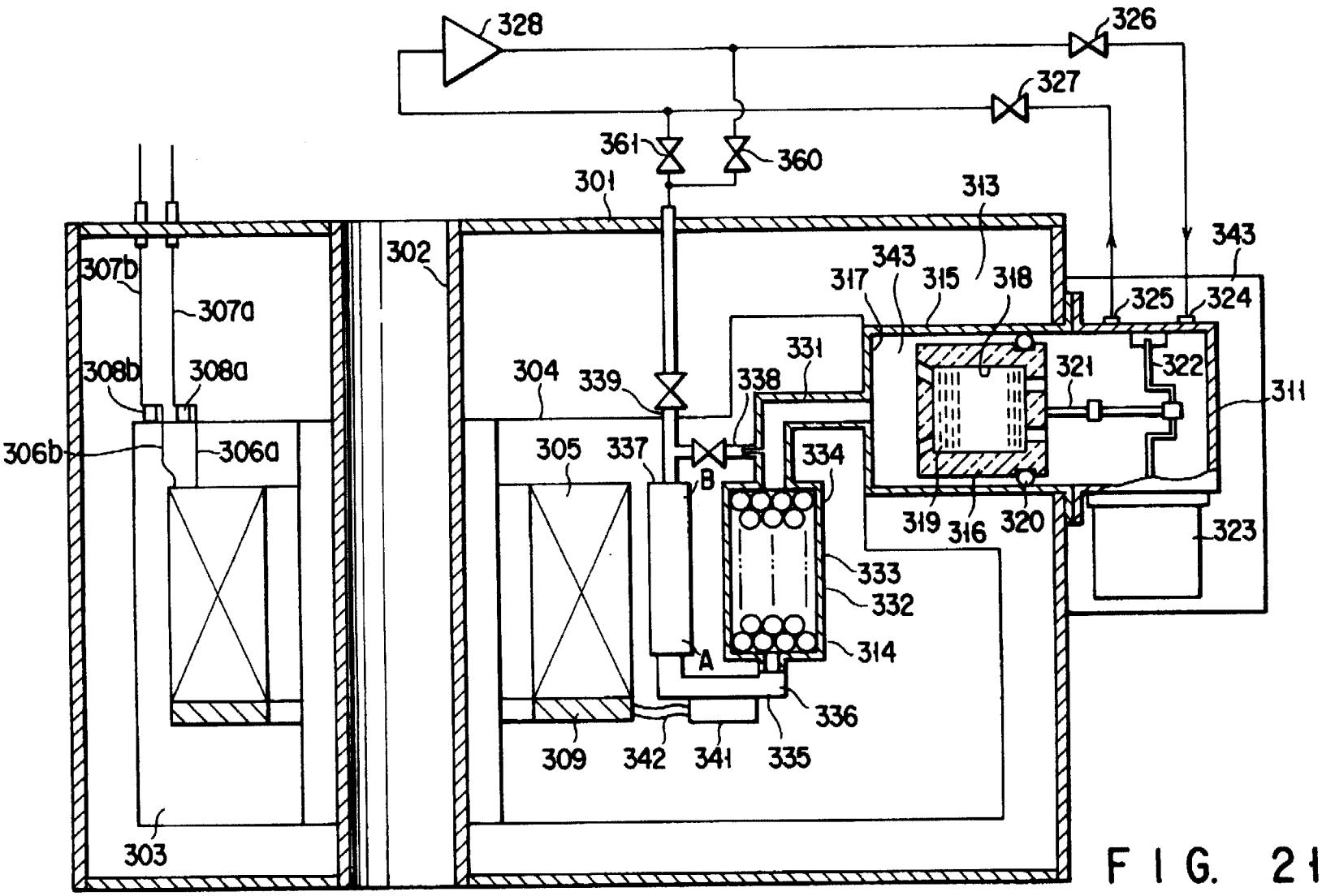
FIG. 21 schematically shows the structure of a superconducting magnet apparatus of a refrigerator direct cooling system, in which a refrigerant-filled chamber type refrigerator according to another embodiment of the invention is built.

FIG. 21 shows a superconducting magnet apparatus of the refrigerator direct cooling system according to another embodiment of the invention. The functional parts common to those in FIG. 17 are denoted by like reference numerals, and a detailed description thereof is omitted.

This embodiment differs mainly from the embodiment of FIG. 17 with respect to the structure of a phase control mechanism of the pulse tube refrigerator constituting the second cooling stage. Specifically, the apparatus shown in FIG. 21 includes a four-valve phase control mechanism.

The four-valve phase control mechanism mainly comprises a low-pressure valve 327, a compressor 328, a high-pressure valve 326, an auxiliary high-pressure valve 360 and an auxiliary low-pressure valve 361. In a gas control system of the four-valve phase control mechanism, the outlet 325 is connected to the inlet 324 via the low-pressure valve 327, compressor 328 and high-pressure valve 326. A gas discharge end portion of the compressor 328 is connected via the auxiliary high-pressure valve 360 to end portion of the capillary tube 339, which projects to the normal-temperature region. A gas suction end portion of the compressor 328 is connected via the auxiliary low-pressure valve 361 to the end portion of the capillary tube 339, which projects to the normal-temperature region. The low-pressure valve 327 and high-pressure valve 326 are synchronized with the rotation of the motor 323 and are opened/closed in relation to the volume (varying in a range of 0 to Vmax) of the first expansion chamber defined in the cylinder 315 in the manner illustrated in FIG. 7 or 15. The auxiliary high-pressure valve 360 and auxiliary low-pressure valves 361 serve to set a predetermined phase difference between the phase of pressure variation in the pulse tube refrigerator, which constitutes the second cooling stage, and the phase of displacement of gas. The auxiliary high-pressure valve 360 and auxiliary low-pressure valve 361 are similarly opened/closed in synchronism with the rotation of the motor 323 in the manner illustrated in FIG. 7 or 15.

In this embodiment, the auxiliary high-pressure valve 360 and auxiliary low-pressure valve 361 for supplying high-pressure helium gas to the portion of the capillary tube 339 projecting to the normal-temperature region and for exhausting the helium gas therefrom are provided in order to increase the coldness generation amount in the second cooling stage 335 by providing a predetermined phase difference between the phase of pressure variation in the pulse tube 337 and the phase of displacement of gas. The auxiliary high-pressure valve 360 and auxiliary low-pressure valve 361 are opened/closed in synchronism with the reciprocal movement of the displacer 316. Specifically, as shown in FIG. 7, the auxiliary high-pressure valve 360 is opened/closed at a timing earlier than the high-pressure valve 326, and the auxiliary low-pressure valve 361 is opened/closed at a timing earlier than the low-pressure valve 327. By this control, the coldness generation amount at the second cooling stage 335 can be increased.

In this embodiment, a coldness-accumulating material is contained in the capillary tube 339, thereby to prevent normal-temperature helium gas from entering the body of the pulse tube 337 via the auxiliary high-pressure valve 360. Thus, the coldness-accumulating material prevents the entrance of heat from the normal-temperature region and allows a helium gas at a temperature substantially equal to the temperature of the first cooling stage 317 to flow into the high-temperature end portion of the body of the pulse tube 337.

In the above structure, the high-temperature end portion of the pulse tube 337 of the pulse tube refrigerator is substantially located in the normal-temperature region. Thus, a phase control mechanism necessary for the pulse tube refrigerator can easily be provided, and the coldness generation amount in the pulse tube 337 can be increased. Therefore, the refrigeration power can remarkably be enhanced. In other words, since the phase control mechanism is provided in the normal-temperature region, the operability, reliability and easiness of maintenance of valves, etc. can remarkably be enhanced.

Figure 22:
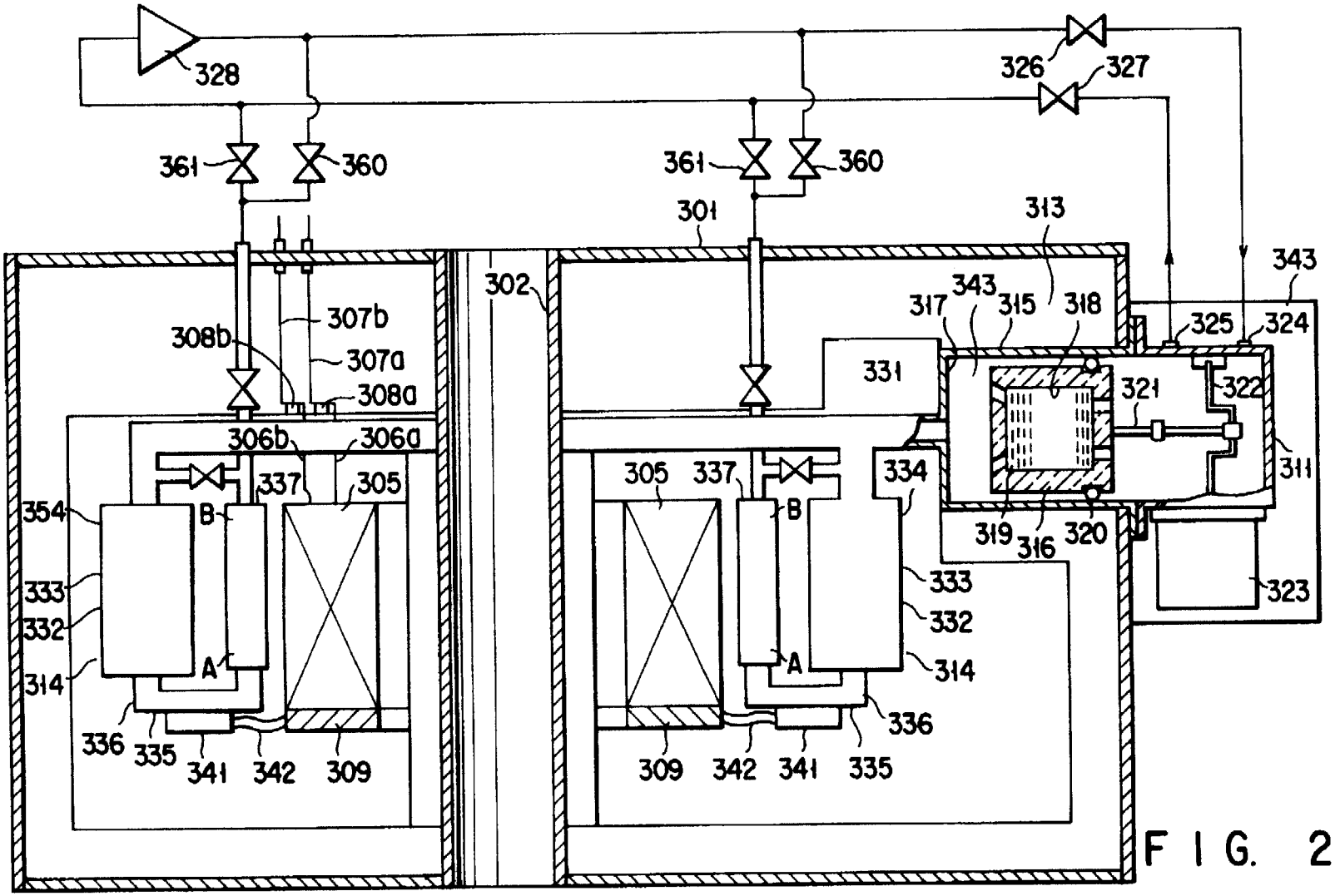
FIG. 22 schematically shows the structure of a superconducting magnet apparatus of a refrigerator direct cooling system, in which a refrigerant-filled chamber type refrigerator according to another embodiment of the invention is built.

FIG. 22 shows a superconducting magnet apparatus of the refrigerator direct cooling system according to another embodiment of the invention. The functional parts common to those in FIGS. 17 and 20 are denoted by like reference numerals, and a detailed description thereof is omitted.

This embodiment differs mainly from the embodiment of FIGS. 17 and 18 with respect to the refrigerating structure of the pulse tube refrigerator constituting the second-stage refrigerating unit for refrigerating the superconducting coil, and the phase control mechanism of the pulse tube refrigerator constituting the second-stage refrigerating unit.

The apparatus of this embodiment includes four branched second-stage refrigerating units 314. The branched second-stage refrigerating units 314 are arranged equidistantly around the axis of the superconducting coil 305. In addition, endothermic units 341 or the cooling stages of the second-stage refrigerating units are thermally connected to the superconducting coil 305 with heat conductive members 342 interposed. Thus, the superconducting coil 305 can be uniformly cooled so that no temperature difference occurs in the coil 305. Furthermore, since the second-stage refrigerating units 314 are arranged equidistantly around the axis of the superconducting coil 305 to cool the superconducting coil 305, a magnetic coldness-accumulating material does not disturb the symmetry of magnetic field generated by the superconducting coil 305, even if the material is used in each of the refrigerant-filled chambers 337 of the second-stage refrigerating units 314. Therefore, a correcting operation for enhancing symmetry can be easily performed.

The apparatus shown in FIG. 22 includes a four-valve phase control mechanism. The four-valve phase control mechanism mainly comprises a low-pressure valve 327, a compressor 328, a high-pressure valve 32695, a plurality of auxiliary high-pressure valves 360 and a plurality of auxiliary low-pressure valves 361. In a gas control system of the four-valve phase control mechanism, the outlet 325 is connected to the inlet 324 via the low-pressure valve 327, compressor 328 and high-pressure valve 326. A gas discharge end portion of the compressor 328 is connected via the auxiliary high-pressure valves 360 to end portions of the capillary tubes 339, which project to the normal-temperature region. A gas suction end portion of the compressor 328 is connected via the auxiliary low-pressure valves 361 to the end portions of the capillary tubes 339, which project to the normal-temperature region. The low-pressure valve 327 and high-pressure valve 326 are synchronized with the rotation of the motor 323 and are opened/closed in relation to the volume (varying in a range of 0 to Vmax) of the first expansion chamber defined in the cylinder 315 in the manner illustrated in FIG. 7 or 15. The auxiliary high-pressure valves 360 and auxiliary low-pressure valves 361 serve to set a predetermined phase difference between the phase of pressure variation in the pulse tube refrigerator, which constitutes the second cooling stage, and the phase of displacement of gas. The auxiliary high-pressure valves 360 and auxiliary low-pressure valves 361 are similarly opened/closed in synchronism with the rotation of the motor 323 in the manner illustrated in FIG. 7 or 15.

In this embodiment, the auxiliary high-pressure valves 360 and auxiliary low-pressure valves 361 for supplying high-pressure helium gas to the portions of the capillary tubes 339 projecting to the normal-temperature region and for exhausting the helium gas therefrom are provided in order to increase the coldness generation amount in the second cooling stage 335 by providing a predetermined phase difference between the phase of pressure variation in the pulse tube 337 and the phase of displacement of gas. The auxiliary high-pressure valves 360 and auxiliary low-pressure valves 361 are opened/closed in synchronism with the reciprocal movement of the displacer 316. Specifically, as shown in FIG. 7 or 15, the auxiliary high-pressure valves 360 are opened/closed at a timing earlier than the high-pressure valve 326, and the auxiliary low-pressure valves 361 are opened/closed at a timing earlier than the low-pressure valve 327. By this control, the coldness generation amount at the second cooling stage 335 can be increased.

In this embodiment, a coldness-accumulating material is contained in each capillary tube 339, thereby to prevent normal-temperature helium gas from entering the body of the associated pulse tube 337 via the associated auxiliary high-pressure valve 360. Thus, the coldness-accumulating material prevents the entrance of heat from the normal-temperature region and allows a helium gas at a temperature substantially equal to the temperature of the first cooling stage 317 to flow into the high-temperature end portion of the body of the associated pulse tube 337.

In the above structure, the high-temperature end portion of each pulse tube 337 of the pulse tube refrigerator is substantially located in the normal-temperature region. Thus, a phase control mechanism necessary for the pulse tube refrigerator can easily be provided, and the coldness generation amount in the pulse tube 337 can be increased. Therefore, the refrigeration power can remarkably be enhanced. In other words, since the phase control mechanism is provided in the normal-temperature region, the operability, reliability and easiness of maintenance of valves, etc. can remarkably be enhanced.

The present invention is not limited to the above-described embodiments. In the embodiments, although the first-stage refrigerating unit adopts the Gifford-McMahon (GM) refrigeration cycle or the Stirling refrigerating cycle, it can adopt the improved Solvay refrigerating cycle. In the above embodiments, the refrigerating system comprises two-stage refrigerating units. However, the refrigerating system may comprise three or more stages of units. The high-temperature end portion of the pulse tube of the pulse tube refrigerator may be extended to the normal-temperature region, and the phase control mechanism of the pulse tube refrigerator may be provided in the normal-temperature region. In the case where the high-temperature end portion of the pulse tube is extended to the normal-temperature region, a coldness-accumulating material may be contained in the high-temperature portion of the pulse tube to prevent entrance of heat from the normal-temperature region.

As has been described above, according to the present invention, the total length of the refrigerator can be greatly reduced, and the applicability to various objects to be cooled is enhanced. Furthermore, since the pulse tube refrigerator requiring no sliding seal element is used as final-stage refrigerating unit, the refrigeration power of the final-stage refrigerating unit can be enhanced.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A superconducting magnet apparatus comprising:

a superconducting coil unit; and a refrigerant-filled chamber type refrigerator having a plurality of cooling stages, at least a final cooling stage of said cooling stages including a static-type refrigerant-filled chamber and being associated with said superconducting coil unit, and at least a first cooling stage of said cooling stages including a movable-type refrigerant-filled chamber.

2. The superconducting magnet apparatus according to claim 1, further comprising a phase control unit for controlling at a predetermined value a phase difference between the phase of variation of pressure in said final cooling stage and the phase of displacement of a refrigerant gas.

3. The superconducting magnet apparatus according to claim 1, wherein said phase control unit comprises:

a gas compressor connected to the inlet side of the final cooling stage;

a first valve disposed between the discharge side of the gas compressor and the inlet side of the final cooling stage;

a second valve disposed between the suction side of the gas compressor and the inlet side of the final cooling stage;

a first valve control unit for selectively opening/closing alternately the first and second valves to permit a high-pressure refrigerant gas discharge side of the gas compressor to be guided into the first cooling stage through the final cooling stage and then to permit said refrigerant gas to be sucked into the gas compressor through the suction side thereof via the reverse passageway so as to generate coldness;

a third valve disposed between the other end portion of the first cooling stage and the discharge side of the gas compressor;

a fourth valve disposed between the other end portion of the first cooling stage and the suction side of the gas compressor; and a second valve control unit for serving to open/close the third and fourth in relation to the opening/closing of the first and second valves.

4. The superconducting magnet apparatus according to claim 3, further comprising a buffer tank connected to the other end portion of said first cooling stage.

5. The superconducting magnet apparatus according to claim 1, further comprising a vibration transmission preventing unit, provided between the refrigerant-filled chamber of the first cooling stage and the refrigerant-filled chamber of the final cooling stage, for preventing transmission of vibration of the refrigerant-filled chamber of the first cooling stage to the refrigerant-filled chamber of the final cooling stage.

6. The superconducting magnet apparatus according to claim 1, wherein said refrigerant-filled chamber type refrigerator comprises a pipe for connecting the refrigerant-filled chamber of the first cooling stage and the refrigerant-filled chamber of the final cooling stage, said pipe including, at least partially, a flexible pipe.

7. The superconducting magnet apparatus according to claim 1, further comprising:

a first container for containing said superconducting coil unit and said final cooling stage;

a second container for containing said first cooling stage; and a heat insulating pipe for connecting the refrigerant-filled chamber of the final cooling stage contained in the first container and the refrigerant-filled chamber of the first cooling stage contained in the second container.

8. The superconducting magnet apparatus according to claim 1, wherein said first cooling stage is constituted by one of a Gifford-McMahon (GM) refrigeration cycle, a Stirling refrigerating cycle and an improvement-type Solvay refrigerating cycle.

9. The superconducting magnet apparatus according to claim 1, wherein said final cooling stage comprises a pulse tube as an expansion device.

10. The superconducting magnet apparatus according to claim 1, wherein said final cooling stage includes a refrigerant-filled chamber in which a magnetic coldness-accumulating material utilizing abnormal magnetic specific heat due to a magnetic phase transition is used.

11. The superconducting magnet apparatus according to claim 1, wherein said final cooling stage is connected to said superconducting coil unit in one of a manner in which the former is connected to the latter directly and a manner in which the former is connected to the latter with a heat conductive member interposed.

12. The superconducting magnet apparatus according to claim 1, wherein said superconducting coil unit comprises a superconducting coil, a thermal shield surrounding the superconducting coil, a container for containing the superconducting coil.

13. The superconducting magnet apparatus according to claim 1, wherein said final cooling stage is thermally connected to said superconducting coil and comprises a plurality of cooling stage units.

14. The superconducting magnet apparatus according to claim 13, wherein said plurality of cooling stage units are equidistantly arranged around the axis of the superconducting coil unit.

15. The superconducting magnet apparatus according to claim 7, wherein a final-stage portion of the first cooling stage is situated within said first container and the other portion of the first cooling stage is situated outside the first container.

16. The superconducting magnet apparatus according to claim 1, wherein said final cooling stage includes a pulse tube refrigerator provided with a pulse tube, and a high-temperature end portion of the pulse tube of the pulse tube refrigerator substantially extends to a normal-temperature region.

17. The superconducting magnet apparatus according to claim 1, wherein the crossing angle between the axis of the first cooling stage and the axis of the final cooling stage is set at a predetermined value.

18. The superconducting magnet apparatus according to claim 17, wherein said final cooling stage includes a pulse tube refrigerator provided with a pulse tube, and the crossing angle between the axis of the pulse tube of the pulse tube refrigerator and the axis of the final cooling stage is set at one of 90° and 180°.

19. A refrigerant-filled chamber type refrigerator comprising:

a first cooling stage having a movable-type refrigerant-filled chamber;

a second cooling stage having a static-type refrigerant-filled chamber;

a gas compressor connected to the inlet side of the final cooling stage;

a first valve disposed between the discharge side of the gas compressor and the inlet side of the final cooling stage;

a second valve disposed between the suction side of the gas compressor and the inlet side of the final cooling stage;

a first valve control unit for selectively opening/closing alternately the first and second valves to permit a high-pressure refrigerant gas discharge side of the gas compressor to be guided into the first cooling stage through the final cooling stage and then to permit said refrigerant gas to be sucked into the gas compressor through the suction side thereof via the reverse passageway so as to generate coldness;

a third valve disposed between the other end portion of the first cooling stage and the discharge side of the gas compressor;

a fourth valve disposed between the other end portion of the first cooling stage and the suction side of the gas compressor; and a second valve control unit for serving to open/close the third and fourth in relation to the opening/closing of the first and second valves.

20. A refrigerant-filled chamber type refrigerator having a plurality of cooling stages, wherein at least a first cooling stage of said cooling stages including a movable-type refrigerant-field chamber, and at least a final cooling stage of said cooling stages includes a pulse tube refrigerator provided with a pulse tube, and a high-temperature end portion of said pulse tube of the pulse tube refrigerator substantially extends to a normal-temperature region.

21. The refrigerator according to claim 20, further comprising a phase control unit for controlling at a predetermined value a phase difference between the phase of variation of pressure in said final cooling stage and the phase of displacement of a refrigerant gas.

22. The refrigerator according to claim 20, wherein a coldness-accumulating material is contained in said high-temperature end portion of the pulse tube, thereby forming a heat entrance preventing section.

23. The refrigerator according to claim 20, wherein the high-temperature end portion of the pulse tube communicates with said phase control unit via a valve opened and closed in synchronism with operation of the phase control unit.

24. The refrigerator according to claim 20, wherein the high-temperature end portion of the pulse tube communicates via a flow rate restriction element with one of a buffer tank provided in the normal-temperature region and a gas inlet/outlet portion of at least a first cooling stage of said cooling stages.

25. The refrigerator according to claim 20, wherein at least a first cooling stage of said cooling stages is constituted by one of a Gifford-McMahon (GM) refrigeration cycle, a Stirling refrigerating cycle and an improvement-type Solvay refrigerating cycle.

26. A refrigerant-filled refrigerator having a plurality of cooling stages each provided with a refrigerant-filled chamber, wherein at least a final cooling stage of said cooling stages includes a pulse tube refrigerator provided with a pulse tube, and the axis of the pulse tube of the pulse tube refrigerator is substantially parallel to the axis of the refrigerant-filled chamber, and the intersection angle between the axis of the pulse tube and the axis of the cooling stage other than the final cooling stage is set at a predetermined value, wherein at least a first cooling stage of said cooling stages is constituted one of a Gifford-McMahon (GM) refrigeration cycle, a Stirling refrigerating cycle and an improvement-type Solvay refrigerating cycle.

* * * * *